US007172846B2

(12) United States Patent
Yamashita et al.

(10) Patent No.: US 7,172,846 B2
(45) Date of Patent: Feb. 6, 2007

(54) CARRIER, DEVELOPER, IMAGE FORMING APPARATUS AND PROCESS CARTRIDGE

(75) Inventors: Masahide Yamashita, Tokyo (JP); Tomio Kondou, Numazu (JP); Kohsuke Suzuki, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 359 days.

(21) Appl. No.: 10/844,442

(22) Filed: May 13, 2004

(65) Prior Publication Data

US 2005/0003292 A1 Jan. 6, 2005

(30) Foreign Application Priority Data

May 15, 2003 (JP) ..... 2003-137874

(51) Int. Cl.
*G03G 9/00* (2006.01)

(52) U.S. Cl. ..... 430/111.33; 430/111.32; 430/111.34; 430/111.4; 430/111.41; 399/252

(58) Field of Classification Search ..... 430/111.33, 430/111.32, 111.34, 111.4, 111.41; 399/252
See application file for complete search history.

(56) References Cited

U.S. PATENT DOCUMENTS 5,204,207 A 4/1993 Yamashita et al.
5,380,616 A 1/1995 Aoki et al.
5,519,316 A 5/1996 Hagiwara et al.
5,655,199 A 8/1997 Yamashita et al.
5,761,594 A 6/1998 Seto et al.
5,774,775 A 6/1998 Aoto et al.
5,863,690 A 1/1999 Yamashita
5,873,018 A 2/1999 Aoto et al.
5,882,832 A 3/1999 Tosaka et al.
6,074,795 A 6/2000 Watanabe et al.
6,157,801 A * 12/2000 Aita et al. ..... 399/175
6,180,298 B1 1/2001 Kuroda et al.
6,183,926 B1 2/2001 Kuroda et al.
6,221,549 B1 4/2001 Emoto et al.
6,255,028 B1 7/2001 Hasegawa et al.
6,258,502 B1 7/2001 Nakamura et al.
6,303,257 B1 10/2001 Hasegawa et al.
6,363,229 B1 3/2002 Shiraishi et al.
6,403,275 B1 6/2002 Kuramoto et al.
6,406,826 B1 6/2002 Suzuki et al.
6,479,204 B1 11/2002 Uchinokura et al.
6,500,595 B1 12/2002 Mochizuki et al.
6,503,676 B2 1/2003 Yamashita et al.
6,566,026 B2 5/2003 Watanabe et al.
6,593,048 B2 7/2003 Sasaki et al.
6,630,276 B2 10/2003 Sugiura et al.

(Continued)

*Primary Examiner*—Mark A. Chapman
(74) *Attorney, Agent, or Firm*—Oblon, Spivak, McClelland, Maier & Neustadt, P.C.

(57) ABSTRACT

A carrier including a manganese ferrite core material having a layer on its surface such that $0.1 \leqq K \leqq 30$, where $K=(S/M)\times 100$, S and M represent the standard deviation and average of M2/(M1+M2), respectively, M ranging from 0.05 to 0.45, and M1 and M2 represent the content of iron and manganese, respectively, in a carrier particle. The carrier has a magnetization ranging from 45 to 75 emu/g at 1,000 Oe, a mass-averaged particle diameter, D4, ranging from 25 to 65 μm and carrier particles having a particle diameter not greater than 12 μm are included in an amount not greater than 0.3% by weight, and a ratio, D4/D1, ranging from 1 to 1.3, where D1 is a number-averaged particle diameter of the carrier.

24 Claims, 4 Drawing Sheets

U.S. PATENT DOCUMENTS 6,641,969 B2 11/2003 Uchinokura et al.
6,653,037 B2 11/2003 Sawada et al.
6,716,561 B2 4/2004 Shiraishi et al.
6,733,939 B2 5/2004 Nanya et al.
6,743,558 B2 6/2004 Yamaguchi et al.
6,770,411 B2 8/2004 Masuda et al.
2003/0165765 A1 9/2003 Yamashita et al.

* cited by examiner

CARRIER, DEVELOPER, IMAGE FORMING APPARATUS AND PROCESS CARTRIDGE

This document claims priority and contains subject matter related to Japanese Patent Application No. 2003-137874 filed on May 15, 2003 incorporated herein by reference.

BACKGROUND OF THE INVENTION

1. Field of the Invention

The present invention relates to a carrier providing a charge to a toner by frictionizing the toner, a two-component developer including a toner and the carrier, and an image forming apparatus such as copiers and laser printers and a process cartridge using the developer.

2. Discussion of the Background

An electrophotographic image forming method typically forms an electrostatic latent image on a photoconductive image bearer, provides a charged toner to the electrostatic latent image to form a visual image, transfers the visual toner image onto a transfer medium such as papers, and fixes the visual toner image on the transfer medium with a heat, a pressure or a solvent vapor, etc.

The electrophotographic image forming method is broadly classified as a two-component developing method wherein a toner is charged by mixing the toner with a carrier and a one-component developing method wherein a toner is charged without using a carrier.

One-component developing methods are broadly classified into magnetic developing methods and non-magnetic developing methods, depending on whether a toner is magnetically borne by a developing sleeve.

Conventionally, two-component developing methods have good toner charge stability and buildability and stably produce quality images for long periods. These devices are mostly used for printers, copiers, and complex machines which are required to have high-speed printability and quality image reproducibility. One-component developing methods are mostly used for small printers and facsimiles which are required to be space-saving and low-cost.

Recently, the demand for color images has increased significantly, therefore, the demand for stable, high-quality images has also increased significantly.

Japanese Laid-Open Patent Publication No. 58-184157 and Japanese Patent Publication No. 5-8424 disclose two-component developing methods using a magnetic carrier, wherein the carrier has a small particle diameter and a thin magnetic brush formed on the developer such that a latent image is more finely developed to produce high-quality images.

However, the magnetic carrier having a small particle diameter has a low magnetization per particle, and, therefore, the magnetic binding force attracting the particle to a magnetic sleeve is reduced, resulting in carrier transfer, or adhesion, of particles onto the image bearer.

To prevent carrier adhesion of small particles of the magnetic carrier, in developing methods of feeding a developer by rotating a magnet included in a developing sleeve, Japanese Laid-Open Patent Publication No. 2000-137352 discloses a method of setting a lower limit of the carrier saturation magnetization and Japanese Laid-Open Patent Publication No. 2000-338708 discloses a method of setting a lower limit of a product between a particle diameter and a residual magnetization of the magnetic carrier.

In other words, these methods prevent feeding the carrier having a small magnetic binding force. However, as an electrostatic element is added to the carrier in the image developer, a desorption force is occasionally higher than the binding force and carrier adhesion cannot sufficiently be prevented.

In Japanese Laid-Open Patent Publication No. 2000-137352, a saturation magnetization in an electric field of 10,000 Oe is used, such a high electric field is not used in conventional electrophotographic image developers and the carrier adhesion cannot always be sufficiently prevented even when such a method is used.

Japanese Laid-Open Patent Publication No. 4-145451 discloses a method of removing carrier particles having a specific low saturation magnetization, a small particle diameter, and a small specific gravity regardless of their particle diameters to prevent carrier adhesion. However, in Japanese Laid-Open Patent Publication No. 4-145451, although the final properties of the carrier are not disclosed, sufficient prevention of carrier adhesion is not expected at present since further uniformity of the carrier particles is required.

Japanese Laid-Open Patent Publication No. 2002-296846 discloses a method of specifying a volume-average particle diameter, a particle diameter distribution, a magnetization in a magnetic filed of 1,000 Oe of a core material of a carrier, and a magnetization difference between the carrier and scattered materials to prevent carrier adhesion.

It can be supposed that the method of Japanese Laid-Open Patent Publication No. 2002-296846 has a specific prevention effect for carrier adhesion because of the absence of particles having a small magnetic binding force.

Carrier adhesion is thought to occur due to differences on how individual carrier particles react to external forces, and, particularly in developing methods using a magnetic brush, to differences on magnetic binding forces of individual carrier particles.

However, although Japanese Laid-Open Patent Publication No. 2002-296846 specifies a magnetization ratio between carrier and scattered materials, it is silent on how individual carrier particles are directly involved in carrier adhesion. Thus, such a method is still insufficient to produce high-quality images while preventing carrier adhesion.

Further, in Japanese Laid-Open Patent Publication No. 2002-296846, properties of the carrier core material are controlled to prevent carrier adhesion and other effects. However, as the carrier properties largely depend on mechanical, chemical, electrical, physical and thermal properties of a coat layer of the carrier besides the properties of the core material, control only of the core material properties does not always result in sufficient control of carrier properties.

Particularly, as image quality and stability largely depend on surface properties of the carrier used in the image forming apparatus, carrier particles having a coat layer are needed for better image quality.

Recently, in consideration of environmental protection, units using one-component developing method are mostly recycled and reused, while, at the same time, two-component developers are preferred because of their extended useful life.

On the other hand, in order to decrease energy consumption, toner image fixing temperatures continues to decrease, resulting in toners being easily deformed and firmly fixed at a lower temperature.

The two-component developers are deteriorated because of (1) carrier surface abrasion; (2) separation of a coat layer on the carrier surface; (3) carrier crushing; and (4) deterioration of chargeability, transfer from a desired resistivity of the carrier, and generation of foreign particles such as broken pieces and abrasion powders accompanied by fixation (spent) of a toner on the carrier. These cause image quality deteriorations such as deterioration of image density, foggy background, and deterioration of image resolution as well as physical and electrical damages to image carriers.

Many suggestions having some benefit have been made to solve the above-mentioned problems and improve durability of the carrier. As to suggestions focusing on a coat layer of a coated carrier, i.e., a carrier having a coat layer on a surface of its core material, several techniques have been disclosed. For example, Japanese Laid-Open Patent Publication No. 8-6308 discloses a carrier having a coat layer, which is made of a hardened polyimide substance, including specifically bimaleimide, to improve environmental stability, and prevent foggy background and separation of the coat layer. Japanese Patent No. 2998633 discloses a carrier having a resin coat layer wherein a matrix resin that includes dispersed resin particles and electroconductive fine particles is used to minimize toner consumption. Japanese Laid-Open Patent Publication No. 9-311504 discloses a carrier having a coat layer formed of a phenol resin including a hardened amino group on a surface of a spheric complex core particulate material formed of an iron oxide powder and a phenol resin. In this carrier, contents of the iron oxide powder and the amino group are specified in order to obtain a stable frictional charge and durability. Japanese Laid-Open Patent Publication No. 10-198078 discloses a carrier having a coat layer formed of a matrix resin including dispersed resin fine particles and electroconductive fine particles, wherein the matrix resin includes not less than 10% of components of a binder resin of the toner to decrease the influence of toner spent on chargeability. Finally, Japanese Laid-Open Patent Publication No. 10-239913 discloses a carrier having a coat layer formed of a polyimide resin having a repetition group including a diorganosiloxy group and a compound including two or more epoxy groups in a molecule, resulting on a stable charged amount.

However, the level of performance of these conventional techniques is not acceptable at present, particularly considering the fact that further decreases in fixing temperature and higher carrier longevity are expected. In Japanese Laid-Open Patent Publication No. 8-6308, Japanese Patent No. 2998633, and Japanese Laid-Open Patent Publication Nos. 9-311504 and 10-239913, the matrix resin occupies most of the carrier surface alone and the toner fixation mostly depends on the surf ace status of the matrix resin. Therefore, a sufficient solution to the problem at hand is not always obtained.

In Japanese Laid-Open Patent Publication No. 10-198078, which uses a toner having a low temperature fixability, the same components on the surface of the carrier as those of the toner binder resin tend to lead to toner fixation and the toner is not occasionally stably charged from the beginning of the toner agitation process.

Many suggestions of forming a coat layer with a silicone resin having a comparatively low surface energy have also been made. However, silicone resins do not adhere to the core carrier material due to their low surface energy.

Japanese Laid-Open Patent Publication No. 58-108548 discloses a carrier coated with a specific resin; Japanese Laid-Open Patent Publications Nos. 57-40267, 58-108549, 59-166968 and 6-202381 and Japanese Patent Publication No. 1-19584 disclose carriers coated with specific resins including various additives; and Japanese Patent No. 3120460 discloses a carrier coated with a specific resin having an additive adhered on its surface. Japanese Laid-Open Patent Publication No. 8-6307 discloses a carrier mainly coated with a benzoguanamine-n-butylalcohol-formaldehyde copolymer. Japanese Patent No. 2683624 discloses a carrier coated with a cross-linked resin between a melamine resin and a acrylic resin. However, these carriers do not have sufficient durability yet.

To improve charged amount instability of the carrier accompanied by the spent toner on the surface thereof and resistance variation due to an abrasion of the coated resin, Japanese Laid-Open Patent Publications Nos. 2001-117287, 2001-117288 and 2001-188388 disclose a carrier coated with a thermoplastic resin and a carrier coated with the thermoplastic resin having a larger particle diameter than that of the binder resin.

Japanese Laid-Open Patent Publication No. 9-319161 discloses a method of dispersing fine particles of a specific thermoplastic resin in the matrix resin of the coat layer as another method of maintaining the coat layer properties of the carrier, particularly the chargeability thereof. By this method, even an abraded coat layer have equivalent properties to those of the initial coat layer. However, the method does not sufficiently decrease the abrasion.

Even the method in Japanese Patent No. 2998933, wherein an electroconductive fine powder is dispersed at the same time in addition to the specific thermoplastic resin, does not sufficiently decrease the abrasion problem either.

As mentioned above, trials to fundamentally improve carrier adhesion in a two-component developer capable of stably producing high-quality images have not yet been made having the various binding forces and desorption forces applied to the carrier particles in image developers within a desired range. This still remains a difficult challenge.

Further, preventing carrier adhesion and abundantly and softly forming or properly renewing a developer brush on a developing sleeve to properly feed toner onto an electrostatic latent image bearer and produce high-quality images with high image density and without background fouling still remain a difficult problem.

Because of these reasons, a need exists for a carrier producing high-quality images without carrier adhesion.

SUMMARY OF THE INVENTION

Accordingly, an object of the present invention is to provide a carrier for the production of high-quality images without carrier adhesion that will maintain its properties without a substantial change for long periods of time.

Another object of the present invention is to provide a two-component developer including a carrier.

Still another object of the present invention is to provide an image forming apparatus and a process cartridge using such a two-component developer.

Briefly these and other objects of the present invention, as hereinafter will become more readily apparent, can be attained by a carrier including a manganese ferrite core material, and a layer coated on a surface of the manganese ferrite core material, wherein the carrier satisfies the following conditions 1) to 4):

1)

$$0.1 \leqq K \leqq 30 \quad \text{(a)},$$

where $K=(S/M)\times 100$, S represents a standard deviation of $M2/(M1+M2)$, and M represents an average thereof, varying from 0.05 to 0.45. In addition, M1 represents a content of an iron element in a carrier particle and M2 represents a content of a manganese element determined by the following method:

(i) magnetically holding the carrier on a cylindrical sleeve having a magnetic pole area located over a magnetic pole and having a peak magnetic flux density of 100 mT in a direction perpendicular to a rotational axis of the cylindrical sleeve;

(ii) rotating the cylindrical sleeve around its rotational axis for 30 min; and (iii) removing the carrier from the magnetic pole area by applying a force equal to three times the carrier's gravitational weight in the direction perpendicular to the rotational axis of the cylindrical sleeve;

2) having a magnetization between 45 and 75 emu/g at 1,000 Oe;

3) having a mass-averaged particle diameter (D4) between 25 and 65 μm with carrier particles not greater than 12 μm are included in an amount not greater than 0.3% by weight; and 4) having a ratio (D4/D1) of the mass-averaged particle diameter (D4) to a number-averaged particle diameter of the carrier (D1) varying between 1 and 1.3.

These and other objects, features, and advantages of the present invention will become apparent upon consideration of the following description of the preferred embodiments of the present invention taken in conjunction with the accompanying drawings.

BRIEF DESCRIPTION OF THE DRAWINGS

Various other objects, features, and attendant advantages of the present invention will be more fully appreciated as the same becomes better understood from the detailed description when considered in connection with the accompanying drawings, in which like reference characters designate like corresponding parts throughout and wherein.

DETAILED DESCRIPTION OF THE INVENTION

Figure 1:
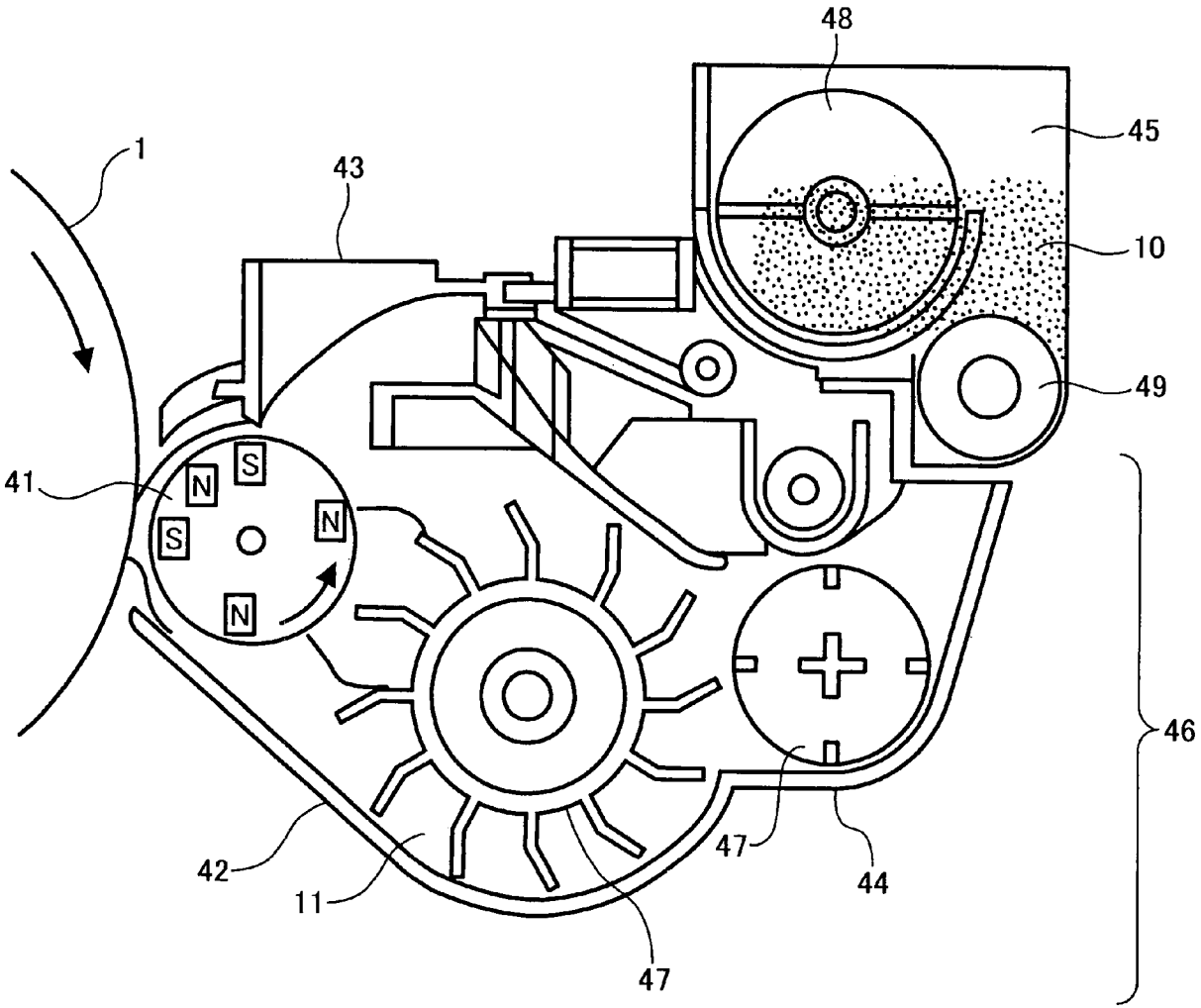
FIG. 1 is a schematic view illustrating a principal part of the image developer of the present invention.

Generally, the present invention provides a carrier capable of prolonging the life span of the various members contacted by the carrier and minimizing damage to the image forming apparatus because of less carrier adhesion.

For example, an amorphous silicon photoreceptor is abraded by a conventional developer until its surface cannot be repaired, but the carrier of the present invention can avoid such a problem. Further, in a surf fixing method, wherein a pressurizer presses an unfixed image to a heater through a film contacting the heater between the heater and pressurizer, the carrier of the present invention can effectively prevent damage to the pressing and fixing film.

The present inventors discovered that a carrier, having a manganese ferrite core material, and a layer coated on a surface of the manganese ferrite core material and satisfying the following conditions 1) to 4), noticeably improves carrier adhesion and image quality:

1)

$$0.1 \leqq K \leqq 30 \quad \text{(a)},$$

where K=(S/M)×100, S represents a standard deviation of M2/(M1+M2), and M represents an average thereof, varying from 0.05 to 0.45. In addition, M1 represents a content of an iron element in a carrier particle and M2 represents a content of a manganese element determined by the following method:

(i) magnetically holding the carrier on a cylindrical sleeve having a magnetic pole area located over a magnetic pole and having a peak magnetic flux density of 100 mT in a direction perpendicular to a rotational axis of the cylindrical sleeve;

(ii) rotating the cylindrical sleeve around its rotational axis for 30 min; and (iii) removing the carrier from the magnetic pole area by applying a force equal to three times the carrier's gravitational weight in the direction perpendicular to the rotational axis of the cylindrical sleeve;

2) having a magnetization between 45 and 75 emu/g at 1,000 Oe;

3) having a mass-averaged particle diameter (D4) between 25 and 65 μm with carrier particles not greater than 12 μm are included in an amount not greater than 0.3% by weight; and 4) having a ratio (D4/D1) of the mass-averaged particle diameter (D4) to a number-averaged particle diameter of the carrier (D1) varying between 1 and 1.3.

An operation or a mechanism of the carrier of the present invention not clearly understood at the present time, but it is supposed to be as explained herein below.

First, carrier adhesion mostly occurs when a desorption force component from an electrostatic force generated by a developing electric field is larger than a magnetic binding force of the carrier particles on the magnetic sleeve. Under these conditions, the magnetic brush is cut and the carrier particles transfer onto the image bearer. Therefore, preventing the formation of a weak binding force in the magnetic brush can decrease carrier adhesion. Further, it is supposed that the weak binding force in the magnetic brush is caused by low-magnetized carrier particles mixed with all the other carrier particles, thus the magnetization problem of the desorbed carrier which could not be held by the magnetic binding force is related to the low-magnetized carrier particles included in the original carrier. Carrier particles having a lower magnetization begin to desorb earlier, including carrier particles that are not uniformly magnetized and, therefore, have a distributed magnetization.

It is considered that the manganese ferrite, including a manganese element and an iron element for use in the present invention, directly causes an unevenness of the magnetization of the carrier due to a nonuniform composition of the metallic elements.

Although not completely understood presently, it is assumed that manganese ferrite typically has a random spinel structure because manganese and iron atoms have comparatively close ion radius, and therefore tetrahedral and octahedral holes filled with an oxygen atom are randomly occupied by the manganese and iron atoms, resulting in a magnetic operation of the lattice structure becoming comparatively weak. Under these conditions, magnetic properties of the manganese and iron elements strongly appear. Therefore, the nonuniform composition of the metallic elements is thought to cause the unevenness of the magnetization of the carrier.

Accordingly, to prepare a magnetic core material for use in the present invention, it is essential to increase the uniformity of the compositions used. For example, it is preferable to see that materials for the magnetic core are sufficiently pulverized and dispersed, that the pulverized and dispersed materials are pre-burned for a controlled time and at a controlled temperature, and that the pre-burned materials are sufficiently pulverized and dispersed.

In addition, as for core material particles in which a magnetic material is dispersed, it is preferable to have the magnetic particles well dispersed in a polymer, and to control conditions of forming the core material particles so as to form as few vacant spaces as possible.

A brief explanation of the four conditions previously state for minimizing the carrier adhesion problem and to improve image quality will now be presented.

As mentioned above, it is essential to have sufficiently uniform compositions of the carrier particles. Namely, a variation coefficient K between the iron and manganese elements varying from 0.1 to 30 is an important condition to prevent uneven magnetic properties of the carrier particles, thereby minimizing carrier adhesion.

When the variation coefficient K is greater than 30, a carrier having a low magnetization is mixed with the carrier having a normal magnetization, resulting in carrier adhesion and poor image quality.

The more uniform the carrier composition, the better. However, core materials have to be mixed for long periods of time to obtain a composition uniformity having a variation coefficient K less than 0.1, making it impractical in terms of production.

When the quantity of iron element in the carrier is M1 and that of manganese is M2, an average M of the ratio M2/(M1+M2) of the manganese element is preferably in the range of 0.05 to 0.45.

When M is greater than 0.45, the resultant carrier does not have sufficient magnetization. When M is less than 0.05, the magnetic ferrite core material tends to have an oxygen defect when prepared in a firing environment, and the magnetization of the resultant carrier varies largely.

When the carrier particles have a distribution of constituents, there is a variation in magnetic binding forces among the particles. Therefore, not only carrier adhesion occurs initially, but, as time passes, it becomes difficult to precisely maintain sufficient magnetic binding forces while controlling the hardness of the magnetic brush.

These are preferably verified in an electrophotographic image forming apparatus actually used or a similar apparatus modified to have severer conditions.

To simply and reliably obtain a desorbed carrier, the carrier is put in an image developer with a developing sleeve having a specific magnetic flux density in its developing area, where carrier desorption is performed for a predetermined time while changing the rotating speed of the sleeve to obtain a desired desorption force.

At least one of the following methods can be used to prepare the carrier of the present invention:

(1) dispersing and mixing materials in a method stronger than a conventional method;

(2) preventing uneven temperature of firing particles of a core material by specifying a thickness, e.g., not greater than 3 cm, of a layer of the particles;

(3) chemically synthesizing a complex oxide of manganese and iron from an aqueous solution beforehand;

(4) mixing and drying a sol of a manganese compound and a sol of an iron compound, and pre-firing the mixture in an oxygen environment; or (5) sufficiently promoting a solid solution (complex oxidization) of an oxide and manganese oxide.

As to the second condition, when the magnetization of the carrier is too unbalanced, all carrier particles probably cause carrier adhesion or hardening of the magnetic brush formed on the developing sleeve to prevent toner from being smoothly fed to and causing damage to an electrostatic latent image bearer, regardless of the above-mentioned compositional uniformity specified in the present invention. Therefore, the carrier needs to have a magnetization (σb) ranging from 45 to 75 emu/g at 1,000 Oe.

When σb is less than 45 emu/g, the magnetization is so low that the carrier magnetic binding force becomes weak, resulting in carrier adhesion. When σb is greater than 75 emu/g, the magnetic brush tends to harden, causing damage to the electrostatic latent image bearer and making it difficult to establish developing conditions to produce high-quality images while effectively preventing carrier adhesion.

Turning now to the third condition, as mentioned above, the carrier preferably has a small particle diameter to produce high-quality images. However, carrier particles having too small a particle diameter have small magnetization and binding forces individually. Therefore, the carrier needs to have a mass-averaged particle diameter ranging from 25 to 65 μm to prevent carrier adhesion and produce high-quality images. For the same reason, carrier adhesion can reliably be prevented when the content of particles in the carrier having a diameter not greater than 12 μm is not greater than 0.3% by weight.

As to the fourth and final condition, when the carrier particle diameter distribution is sharp and uniform, specifically when the ratio D4/D1 ranges from 1 to 1.3, individual carrier particles have a more uniform magnetization and carrier adhesion can be further decreased, and a wide range of developing conditions can be used to produce high-quality images.

When D4/D1 is greater than 1.3, the particle diameter distribution of the carrier is broad, resulting in a large unevenness in the magnetization of individual carrier particles.

When the number of particles in a carrier having a large diameter increases, even for a small increase, D4/D1 increases largely, resulting in a carrier that will prematurely harden developing brushes.

Although a large number of carrier particles having a small particle diameter does not largely increase D4/D1, when it increases, the strength of the electric field capable of sufficiently binding the small particles in the carrier having a small magnetization has to be increased. Therefore, the binding force on the large particles in the carrier becomes too strong and it becomes difficult to provide a magnetic brush having the proper hardness, and further deterioration of the carrier particles is accelerated because an excessive stress is applied thereto.

Accordingly, in the present invention, the carrier having the above-mentioned properties can prevent carrier adhesion and produce high-quality images under a wide range of developing conditions.

Further, to control the electrostatic force applied to a carrier in development to reliably prevent carrier adhesion and produce high-quality images, its resistivity, R, is preferably between $1.0\times10^{9}$ and $1.0\times10^{11}$ Ω·cm when an AC voltage, E, determined according to Equation (2), is applied at a frequency of approximately 1,000 Hz to a carrier magnetic brush having a space occupancy of 40%, which is formed between parallel plate electrodes having a gap of d (mm).

$$E(V)=250\times d, \quad (2)$$

wherein d is 0.40±0.05 mm and E is a peak voltage.

As mentioned above, carrier adhesion is caused by a balance between the magnetic binding force and the force due to mechanical and electrostatic desorption. Therefore, to prevent carrier adhesion, it is preferable that the carrier is electrostatically regulated in addition to the above-mentioned uniformity of its constituents, magnetic regulation, and particle diameter.

When R is greater than $1.0\times10^{11}$ Ω·cm, a charge generated by frictionally charged toner and carrier due to the agitation of the developer is accumulated in the carrier and the carrier is drawn to a non-image forming section of the image bearer, causing carrier adhesion.

When R is less than $1.0\times10^{9}$ Ω·cm, the carrier particles have induced charges and carrier adhesion occurs regardless of where in the image bearer the particles are located, resulting on low quality images.

Surface concavities and convexities of the carrier preferably have an average vertical interval ranging from 0.1 to 2.0 μm, and more preferably from 0.2 to 1.0 μm to ensure abrasion and spent resistance of a carrier coat layer to prevent carrier property variations with time, particularly charging capability and/or resistance.

When the surface concavities and convexities of the carrier have a vertical interval ranging from 0.1 to 2.0 μm, a change with time of an electrostatic force applied to the carrier as a desorption force in a developing section is prevented and carrier adhesion can be prevented even after many images have been produced.

Next, carrier constituents will be explained.

The magnetic ferrite core material for the carrier is not limited so long as the carrier includes specified amounts of manganese and iron as mentioned above, and known ferrites such as manganese ferrite, manganese-magnesium ferrite, manganese-strontium ferrite, and manganese-magnesium-strontium ferrite.

Besides ferrites, for the purpose of controlling the core material resistance and improving its producibility, one or more constituent elements such as Li, Na, K, Ca, Ba, Y, Ti, Zr, V, Ag, Ni, Cu, Zn, Al, Sn, Sb and Bi can be added. The content of these constituent elements is preferably not greater than 5%, and more preferably not greater than 3% by atomic weight based on the total atomic weight of the metals included in the carrier.

The coat layer formed on a surface of the core material is formed of at least an inorganic particulate material and a resin. An insulative inorganic particulate material is preferably used for the inorganic particulate material.

Specific examples of the insulative inorganic particulate material include known insulative powder particles such as aluminum oxide, silicon oxide, sodium carbonate, talc, clay, quartz glass, aluminosilicate glass, mica chip, zirconium oxide, mullite, sialon, steatite, forsterite, cordierite, beryllium oxide and silicon nitride. However, insulative inorganic particulate materials are not limited to these examples.

Particularly, an insulative inorganic particulate material preferably includes an aluminium atom constituent and/or a silicon atom constituent, for example aluminium oxide and silicon oxide, to further prevent desorption of the particles from the coat layer and to more reliably prevent a change of carrier resistance with time.

A method of forming concavities and convexities on the surface of a carrier is not particularly limited, and concavities and convexities can also be formed on inorganic particulate materials in the carrier. To ensure formation of concavities and convexities, the particle content is preferably from 20 to 90%, and more preferably from 25 to 80% by weight per 100% by weight of the constituents of the coat layer.

When the content of the particles is less than 20% by weight, the concavity and convexity on the surface of the carrier tends to be gentle and does not sufficiently scrape spent toner occasionally. On the other hand, when the content of the particles is greater than 90%, the concavity and convexity tends to be brittle and the initial concavity and convexity cannot occasionally be maintained.

The resin forming the coat layer of the carrier is not particularly limited and specific examples thereof include cross-linked copolymers, such as polyolefin, polyethylene, and polypropylene and their modified resins, styrene, acrylic resins, acrylonitrile, vinylacetate, vinylalcohol, vinylcarbazole and vinylether; silicone resins formed of an organosiloxane bond or its modified resins by alkyd resins, polyester resins, epoxy resins, polyurethane, etc.; polyimide; polyester; polyurethane, polycarbonate; urea resins; melamine resins; benzoguanamine resins; epoxy resins; polyimide resins; and their derivatives.

Particularly, the resin in the coat layer preferably includes an acrylic section as a constitutional unit to reliably fix the insulative inorganic particles in the coat layer and to effectively prevent desorption due to friction. The acrylic section in the coat layer can quite effectively prevent the desorption of the inorganic particles due to friction and can maintain the concavity and convexity on the surface of the carrier for long periods.

Further, the acrylic resin preferably has a glass transition temperature ranging from 20 to 100° C., and more preferably from 25 to 80° C. The acrylic resin having a glass transition temperature in the above-mentioned range has a moderate elasticity, and it is considered that the impact the carrier receives when the developer is frictionally charged is decreased to prevent damage to the coat layer.

Further, the resin in the coat layer is preferably a cross-linked resin between an acrylic resin and an amino resin to prevent the resins from fusion bonding each other, i.e., formation of blocks tending to occur when only the acrylic resin is used while maintaining moderate elasticity.

Specific examples of amino resins include known amino resins. Particularly, guanamine resins and melamine resins are preferably used to improve charging capability of the carrier. When the charging capability needs to be properly controlled, other amino resins may be used together with the guanamine resins and/or melamine resins. Further, the resin in the coat layer preferably includes a silicone section as a constitutional unit to decrease the surface energy of the carrier and prevent occurrence of spent toner, maintaining carrier properties for a long time.

The constitutional unit of the silicone section preferably includes a unit selected from the group consisting of methyltrisiloxane units, dimethyldisiloxane units and trimethylsiloxane units. The silicone portion maybe chemically bonded, blended or multilayered with other resins in the coat layer. When multilayered, the silicone section is preferably located at an uppermost surface of the layer.

When blended and multilayered, silicone resins and/or its modified resins are preferably used. Specific examples of the silicone resins include any known silicone resins. Particularly, thermosetting silicone resins capable of having a three-dimensional network structure, straight silicone only formed of an organosiloxane bond having the formula shown in (1) and silicone resins modified by alkyd, polyester, epoxy urethane are preferably used.

(1)

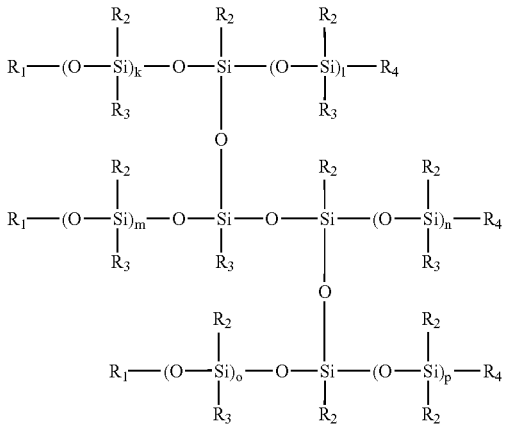

wherein $R_1$ represents a hydrogen atom, an alkyl group having 1 to 4 carbon atoms or a phenyl group; $R_2$ and $R_3$ independently represent a hydrogen atom, an alkoxy group having 1 to 4 carbon atoms, a phenyl group, a phenoxy group, an alkenyl group having 2 to 4 carbons atoms, an alkenyloxy group having 2 to 4 carbon atoms, a hydroxy group, a carboxyl group, an ethylene oxide group, a glycidyl group or a group having the following formula:

(2)

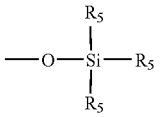

wherein $R_4$ and $R_5$ independently represent a hydroxy group, a carboxyl group, an alkyl group having 1 to 4 carbon atoms, an alkoxy group having 1 to 4 carbon atoms, an alkenyl group having 2 to 4 carbon atoms, an alkenyloxy group having 2 to 4 carbon atoms, a phenyl group and a phenoxy group; and k, l, m, n, o and p independently represent integers.

Each of the above-mentioned substituents may be unsubstituted and may have substituents such as a hydroxy group, a carboxyl group, an alkyl group, a phenyl group and a halogen atom.

The coat layer preferably includes conductive or semiconductive particles having a number-averaged particle diameter smaller than that of the particles forming surface concavities and convexities, typified by the above-mentioned insulative inorganic particles to precisely control the carrier resistance.

Known conductive or semiconductive particles can be used. Specific examples of the conductive particles include metals such as iron, gold and copper; iron oxide, such as ferrite and magnetite; oxides such as bismuth oxide and molybdenum oxide; ionic conductors such as silver iodide and β-alumina; and pigments such as carbon black. Specific examples of the semiconductive particles include double oxides such as barium titanate, strontium titanate, and lead lanthanum titanate; titanium oxide; zinc oxide; oxygen defect formations of tin oxide (Frankel type semiconductors); and impurity type defect formations (Schottky type semiconductors).

Among these conductive or semiconductive particles, particularly furnace black and acetylene black are preferably used because even a small amount of low-resistance fine powders of these particles can effectively control conductivity.

Low-resistance fine powders need to be smaller than the particles forming carrier surface concavities and convexities, and, preferably, have a number-averaged particle diameter ranging from 0.01 to 1 μm and a content from 2 to 30 parts by weight per 100 parts by weight of the resin in the coat layer.

Known methods can be used to form coat layers, and a coating liquid for forming the coat layer can be coated on a surface of the core material particle by spray coating methods, dip coating methods, etc. The coat layer preferably has a thickness varying from 0.01 to 20 μm, and more preferably from 0.3 to 10 μm.

The carrier particle on which the coat layer is formed is preferably heated to promote a polymerization reaction of the coat layer.

The carrier may be heated in a coating apparatus or other heating means such as ordinary electric ovens and sintered kiln after the coat layer is formed.

The carrier heating temperature varies depending on the material used for the coat layer, but a temperature ranging from 120 to 350° C. is preferably used. The heating temperature is preferably not greater than the decomposition temperature of the resin used for the coat layer and preferably has an upper limit of 200° C. In addition, a heating time is preferably between 5 and 120 min.

The electrophotographic carrier of the present invention can be used in an electrophotographic developer including a toner having at least a binder resin and a colorant, which can prevent carrier adhesion and produce high-quality images. The toner is preferably included in the developer in an amount ranging from 2 to 12%, and more preferably from 2.5 to 10% by weight.

Any constituents can be used without a particular limit for a toner included in the electrophotographic developer of the present invention.

Specific examples of the binder resin for use in the toner include styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; acrylic ester polymers and copolymers such as polymethylacrylate, polybutylacrylate, polymethylmethacrylate and polybutylmethacrylate; polyvinyl derivatives such as polyvinylchloride and polyvinylacetate; polyester polymers; polyurethane polymers; polyamide polymers; polyimide polymers; polyol polymers; epoxy polymers; terpene polymers; aliphatic or alicycle hydrocarbon resins; aromatic petroleum resins; etc. These can be used alone or in combination, but the resins in the scope of the present invention are not limited to these examples. Among these resins, at least a resin selected from the group consisting of styrene-acrylic copolymer resins, polyester resins and polyol resins is preferably used to impart good electric properties to the resultant toner and to reduce its production cost. Further, the polyester resins and/or the polyol resins are more preferably used to impart good fixability to the resultant toner.

Known pigments and dyes having been used as colorants for toners can be used as colorants for use in the electrophotographic toner of the present invention. Specific examples of the colorants include carbon black, lamp black, iron black, cobalt blue, nigrosin dyes, aniline blue, phthalocyanine blue, phthalocyanine green, Hansa Yellow G, Rhodamine 6C Lake, chalco oil blue, chrome yellow, quinacridone red, benzidine yellow, rose Bengal, etc. These can be used alone or in combination.

The toner included in the electrophotographic developer preferably includes a release agent to perform an oilless fixation without using a fixing oil. Waxes such as polyethylene wax, propylene wax and carnauba wax are preferably used as the release agent included in the toner, but release agents are not limited to these examples. The content of release agent is preferably between 0.5 and 10.0%, and more preferably between 3.0 and 8.0% by weight, depending on the release agent and fixing method used for the resultant toner.

Known additives can be used to improve toner's fluidity and environmental resistance. Specific examples of additives include inorganic powders and hydrophobized inorganic powders such as zinc oxide, tin oxide, aluminium oxide, titanium oxide, silicon oxide, strontium titanate, valium titanate, calcium titanate, strontium zirconate, calcium zirconate, lanthanum titanate, calcium carbonate, magnesium carbonate, mica, and dolomite. These can be used alone in combination.

As to other additives, fine particles of fluorocarbon resins, such as polytetrafluoroethylene, tetrafluoroethylene-hexafluoropropylene copolymers and polyfluorovinylidene, may be used as toner surface improvers. These additives are externally added to the toner particles in an amount varying from 0.1 to 10 parts by weight per 100 parts by weight of the toner particles, depending on the additives used. The additives are optionally mixed in a mixer to adhere or agglutinate on the surface of the tone, or to be free among the toner particles.

Besides, as charge controlling agents improving chargeability of the resultant toner, known charge controlling agents, e.g., positive charge controlling agents, such as vinyl copolymers including an amino group, quaternary ammonium salt compounds, nigrosin dyes, polyamine resins, imidazole compounds, azine dyes, triphenylmethane dyes, guanidine compounds and lake pigments; and negative charge controlling agents such as carboxylic acid derivatives, metallic salts of carboxylic acid, alkoxylate, organic metal complexes, and chelate compounds can be used alone or in combination. These can be kneaded and/or added to toner particles. The controlling agents preferably have a dispersed particle diameter not greater than 2.0 μm, and more preferably not greater than 1.0 μm when dispersed in the toner to evenly generate interaction with the surface of the carrier.

The toner particles in the developer of the present invention can be prepared by kneading the materials as mentioned above with known methods using a two-roll, a biaxial extruding kneader, a uniaxial extruding kneader, or the like, and pulverizing and classifying the kneaded materials with known mechanical or airstream methods. Dispersants may be used together to control the dispersing status of the colorant and magnetic materials during kneading. Further, toner particles may include the above-mentioned additives, mixed, for example, by mixers, to improve surface characteristics.

In addition, a polymerized toner prepared by granulating toner particles with starting materials, such as resin monomers and low-molecular-weight resin oligomers, may also be used.

Toner particle charge amounts are difficult to determine because they depend on the charging process used. However, the toner particles in combination with the carrier particles of the present invention have a saturated charge amount preferably ranging from 3 to 40 μc/g, and more preferably from 5 to 30 μc/g.

The toner particles preferably have a mass-averaged particle diameter varying from 4 to 10 μm, and, on a number basis, 10% of the particles have diameters not less than 2.5 μm to produce images having a stable image quality.

In an image developer having a frictional charger to charge the toner by frictionizing the developer, a rotatable holder holding the developer including the charged toner and a magnetic field generator inside, and an image bearer forming an electrostatic latent image, the magnetic binding force can be maintained for particles having a low magnetization, which are mixed in the carrier, and a magnetic brush of the carrier in the developing section can be maintained in good operating condition when the magnetic flux density, B (mT), in a normal direction of a surface of the holder close to a developing area which is in close contact between the holder and the image bearer in the present invention satisfies the mathematical relationship represented by (3).

$$3{,}500/\sigma b \leqq B \leqq 10{,}000/\sigma b \quad (3)$$

Therefore, carrier adhesion can be prevented and high quality images can be produced for long periods.

The image developer preferably has a retainer keeping a minimum separation distance from the image bearer to the developer holder between 0.30 to 0.80 mm in the developing area in order to assure stable image development.

When the distance is less than 0.30 mm, the magnetic brush occasionally cleans the developed toner image from the image carrier surface. When greater than 0.80 mm, toners are developed more on an edge of a solid image than on a center thereof, i.e., an edge effect tends to occur.

The image developer preferably has a voltage applicator applying a DC bias voltage to the image bearer when producing a halftone image by mainly changing a ratio of the developing surface per unit area. In addition, the image developer preferably has a voltage applicator applying a bias voltage, comprising an AC voltage overlapped with a DC voltage, to the developer holder when producing a halftone image by mainly changing the toner adhesion per unit area.

An image forming apparatus including the image developer of this invention is preferably equipped with a toner recycler including at least a cleaner to clean the image bearer and a toner transporter to transport toner collected by the cleaner to a developing section of the image developer to save resources.

When an image forming apparatus, including a transferer transferring toner images formed on image bearers of plural image developers onto a medium and a fixer fixing the tone image thereon, has the above-mentioned image developers, the image forming apparatus produces high quality images while preventing carrier adhesion.

In a process cartridge having a frictional charger charging a toner by frictionizing a developer, a rotatable holder holding the developer including the charged toner and a magnetic field generator inside, an image bearer forming an electrostatic latent image, and a developer including a toner, when the developer is the developer of the present invention and B satisfies the relationship represented by the formula (3), the process cartridge can stably develop images for an extended time without decreasing the amount of carrier in the developer due to carrier adhesion.

The image developer of the present invention will be further explained, referring to FIG. 1. FIG. 1 is a schematic view illustrating a principal part of the image developer of the present invention.

An image developer facing a photoreceptor drum 1, which is a latent image bearer, is mainly constituted of a developing sleeve 41 bearing a developer, a developer containing member 42, a doctor blade 43, and a support case 44.

The support case 44, having an opening in the direction of the photoreceptor drum 1, is combined with a toner hopper 45 in a container containing a toner 10. A developer container 46, containing a developer 11 formed of the toner 10 and carrier particles, which is adjacent to the toner hopper 45, is equipped with a developer stirrer 47, stirring the toner and carrier particles and imparting a friction/separation charge to the toner particles.

The toner hoper 45 is equipped with a toner agitator 48 rotated by a driver (not shown) and a toner feeder 49 inside. The toner agitator 48 and toner feeder 49 feeds the toner 10 in the toner hopper 45 toward the developer container 46 while agitating the toner 10.

The developing sleeve is arranged in a space between the photoreceptor drum 1 and the toner hopper 45. The developing sleeve 41, rotated by a diver (not shown) in the direction indicated by the arrow in FIG. 1, has a magnetic field generator inside fixedly located in a relative position to an image developer to form a magnetic brush with the carrier particles.

The doctor blade 43 is fitted in a body on an opposite side of the developer containing member 42 to the side on which the support case 44 is fitted. The doctor blade 43 is located so as to keep a regular clearance between one of its end and a peripheral surface of the developing sleeve 41.

The toner 10 fed by the toner agitator 48 and toner feeder 49 from the toner hopper 45 is transported to the developer container 46, where the developer stirrer 47 stirs the toner to impart a desired friction/separation charge thereto. Then, the toner 10 is borne by the developing sleeve 41 with the carrier particles (or alone) as the developer 11 and transported to a position facing a peripheral surface of the photoreceptor drum 1, where only the toner 10 is electrostatically combined with the latent image to form a toner image on the photoreceptor drum 1.

Figure 2:
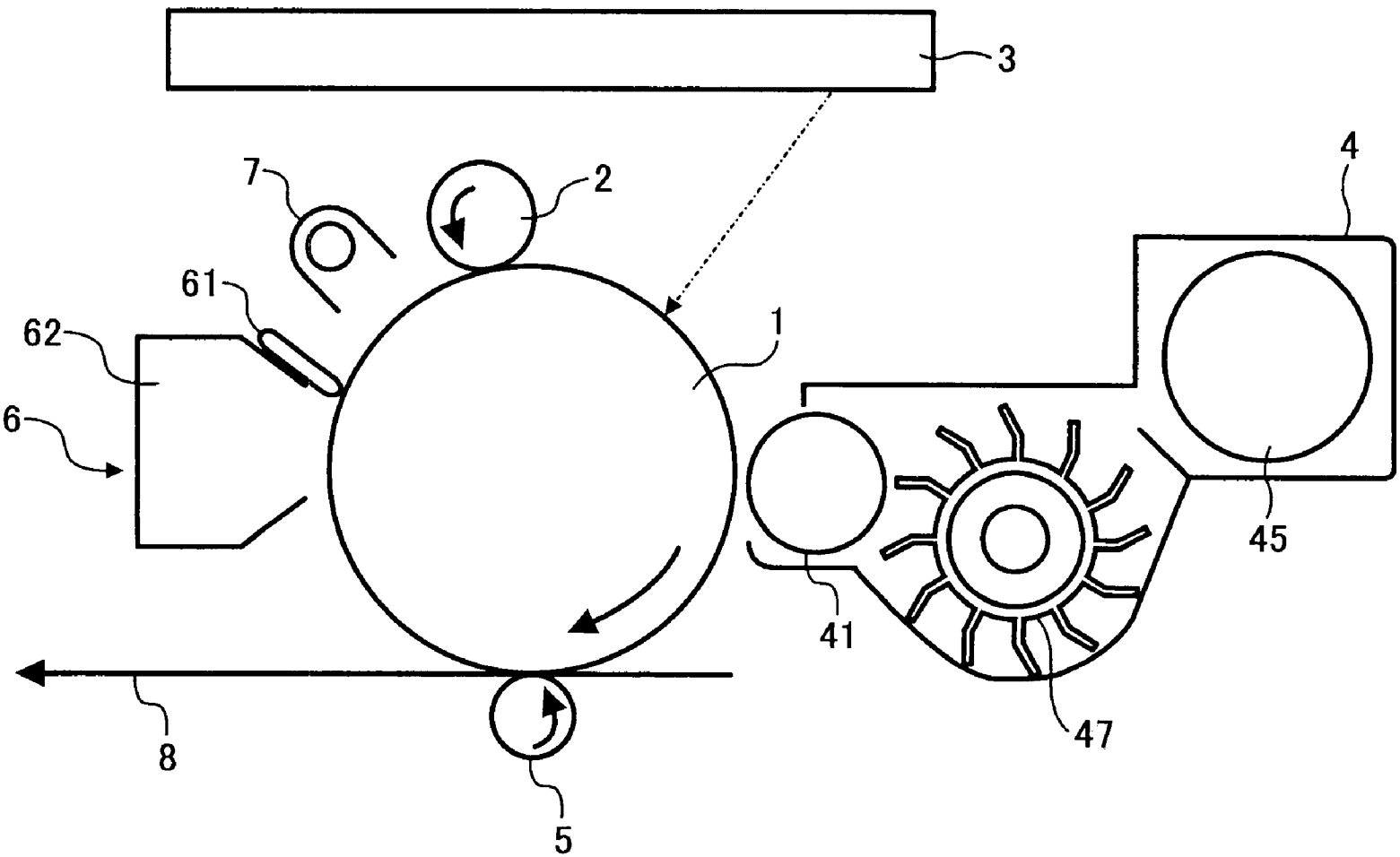
FIG. 2 is a schematic view illustrating an embodiment of an image forming apparatus including the image developer of the present invention.

FIG. 2 is a schematic view illustrating an embodiment of an image forming apparatus including the image developer of the present invention. Around a drum-shaped image bearer 1, a charging member 2 for the image bearer 1, an image irradiator 3, an image developer 4, a transferer 5, a cleaner 6, and a discharge lamp 7 are arranged, and an image is formed as follows.

A negative and positive image forming process will be explained.

The image bearer 1, typified by a photoreceptor (OPC) having an organic photoconductive layer, is discharged by the discharge lamp 7 and negatively and uniformly charged by the charging member 2. Then, a laser beam emitted from the irradiator 3 irradiates the image bearer to form a latent image thereon (the voltage potential of an irradiated part is lower than that of a non-irradiated part).

The laser beam is emitted from a laser diode and a polyangular polygon mirror rotating at a high speed reflects the beam to scan a surface of the image bearer 1 in the direction of rotation of the mirror.

Then, the latent image is developed with the developer formed of the toner particles, or a mixture of the toner particles and the carrier particles, fed on the developing sleeve 41, which is a developer bearer in the image developer, to form a visual toner image.

When the latent image is developed, a voltage applicator (not shown) applies an appropriate voltage between the irradiated part and non-irradiated part of the image bearer, or a developing bias in which an AC voltage is overlapped with the voltage, to the developing sleeve 41.

On the other hand, a transfer medium, such as papers 8, is fed synchronously from a paper feeder (not shown) to a clearance between the image bearer 1 and the transferer 5 by a pair of top and bottom resist rollers and the toner image is transferred to the transfer medium. Then, a transfer bias, preferably a potential having a reverse polarity to that of the toner charge, is applied to the transferer and the transfer medium, or an intermediate transfer medium 8, is separated from the image bearer 1 to have a transferred image.

The toner particles remaining on the image bearer are collected with a cleaning member 61 in a toner collection space 62 in the cleaner 6.

The collected toner particles may be transported by a toner recycler (not shown) to the image developer and/or the toner feeder and used again.

The image forming apparatus may have plural image developers, similar to the ones mentioned above, to sequentially transfer plural toner images on a transfer medium and transport the transfer medium to a fixer to fix the toner image thereon with heat, etc., or may transfer the plural toner images on an intermediate transfer medium once, transfer the plural toner images together on a transfer medium and fix the toner images.

An amorphous silicon photoreceptor (hereinafter referred to as an a-Si photoreceptor) can effectively be used as an image bearer installed in the image forming apparatus of the present invention, which is formed by heating an electroconductive substrate to a temperature ranging from 50 to 400° C. and forming an a-Si photosensitive layer on the substrate by several methods, including vacuum deposition, sputtering, ion plating, heat CVD, photo CVD, plasma CVD, among others. Particularly, the plasma CVD method is preferably used, which forms an a-Si layer on the substrate by decomposing a gaseous material with a DC, high-frequency voltage or a microwave glow discharge.

FIGS. 3A to 3D are a schematic views illustrating a photosensitive layer composition of amorphous photoreceptors for use in the present invention.

Figure 3A:
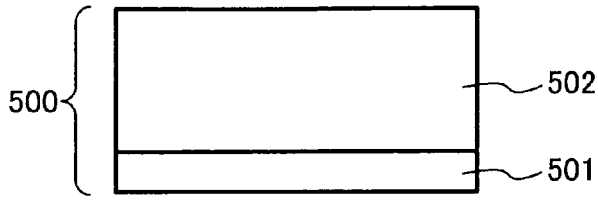
FIGS. 3A to 3D are schematic views illustrating photosensitive layer compositions of the photoreceptor of the present invention.
Figure 3B:
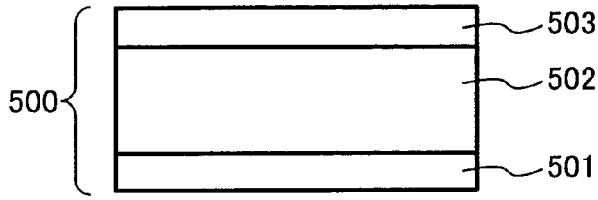

An electrophotographic photoreceptor 500 in FIG. 3A includes a substrate 501 having a photosensitive layer 503, which is photoconductive and formed of a-Si. An electrophotographic photoreceptor 500 in FIG. 3B includes a substrate 501, a photosensitive layer 502, and an a-Si surface layer 503 on the photosensitive layer 502. An electrophotographic photoreceptor 500 in FIG. 3C includes a substrate 501, a charge injection prevention layer 504 thereon, a photosensitive layer 502 on the charge injection prevention layer 504, and an a-Si surface layer 503 on the photosensitive layer 502. An electrophotographic photoreceptor 500 in FIG. 3D includes a substrate 501, a photosensitive layer 502 thereon including a charge generation layer 505 and a charge transport layer formed of a-Si, and an a-Si surface layer 503 on the photosensitive layer 502.

The substrate of the photoreceptor may either be electroconductive or insulative. Specific examples of the substrate include metals such as Al, Cr, Mo, Au, In, Nb, Te, V, Ti, Ot, Od and Fe and their alloyed metals such as stainless.

In addition, insulative substrates, such as films or sheets of synthetic resins, such as polyester, polyethylene, polycarbonate, cellulose acetate, polypropylene, polyvinylchloride, polystyrene, and polyamide glasses, and ceramics can be used, provided that at least on a surface of the substrate a photosensitive layer is formed treated to be electroconductive.

The substrate has the shape of a cylinder, a plate or an endless belt having a smooth or a concave-convex surface. The substrate can have a desired thickness, which can be as thin as possible when an electrophotographic photoreceptor, including the substrate, is required to have flexibility. However, the thickness is typically not less than 10 μm in terms of production and handling conveniences, and a mechanical strength of the electrophotographic photoreceptor.

Figure 3C:
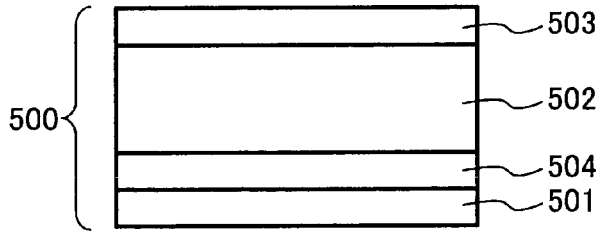
Figure 3D:
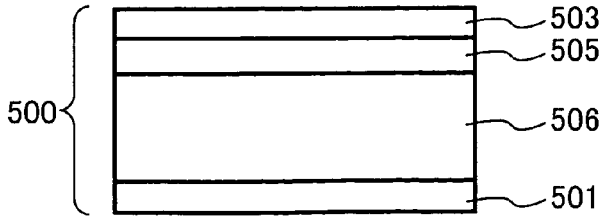

The a-Si photoreceptor of the present invention may optionally include a charge injection prevention layer between the electroconductive substrate and the photosensitive layer as illustrated in FIG. 3C.

When the photosensitive layer is charged with a charge having a certain polarity, the charge injection prevention layer prevents the charge from being injected into the photosensitive layer from the substrate. However, the charge injection prevention layer does not prevent the charge from reaching the photosensitive layer when it is charged with a charge having a reverse polarity, i.e., the behavior of the charge injection prevention layer is polarity sensitive. The charge injection prevention layer includes more atoms controlling conductivity than the photosensitive layer in order to have such a capability.

The charge injection prevention layer preferably has a thickness ranging from 0.1 to 5 μm, more preferably from 0.3 to 4 μm, and most preferably from 0.5 to 3 μm in terms of desired electrophotographic properties and economic effects.

The photosensitive layer 502 is formed on an undercoat layer optionally formed on the substrate 501 and has a thickness as desired, and preferably varying from 1 to 100 μm, more preferably from 20 to 50 μm, and most preferably from 23 to 45 μm in terms of desired electrophotographic properties and economic effects.

The charge transport layer is a layer transporting a charge when the photosensitive layer is functionally separated. The charge transport layer includes at least a silicon atom, a carbon atom and a fluorine atom, and optionally includes a hydrogen atom and an oxygen atom. Further, the charge transport layer has a photosensitivity, a charge retainability, a charge generation capability, and a charge transportability as desired. In the present invention, the charge transport layer preferably includes an oxygen atom.

The charge transport layer has a thickness as desired in terms of electrophotographic properties and economic effects, and preferably its thickness varies from 5 to 50 μm, more preferably from 10 to 40 μm, and most preferably from 20 to 30 μm.

The charge generation layer is a layer generating a charge when the photosensitive layer is functionally separated.

The charge generation layer includes at least a silicon atom, does not include a carbon atom, and substantially and optionally includes a hydrogen atom. Further, the charge generation layer has a photosensitivity, a charge generation capability and a charge transportability as desired.

The charge transport layer has a thickness as desired in terms of electrophotographic properties and economic effects, and preferably such thickness ranges from 0.5 to 15 μm, more preferably from 1 to 10 μm, and most preferably from 1 to 5 μm.

The a-Si photoreceptor for use in the present invention can optionally include a surface layer on the photosensitive layer formed on the substrate, which is preferably a a-Si surface layer. The surface layer has a free surface and is formed to attain objects of the present invention in humidity resistance, repeated use resistance, electric pressure resistance, environment resistance, and durability of the photoreceptor.

The surface layer preferably has a thickness from 0.01 to 3 μm, more preferably from 0.05 to 2 μm, and most preferably from 0.1 to 1 μm. When less than 0.01 μm, the surface layer is lost due to abrasion while the photoreceptor is used. When greater than 3 μm, deterioration of the electrophotographic properties such as an increase of residual potential of the photoreceptors occurs.

The fixer installed in the image forming apparatus of the present invention includes a heater equipped with a heating element, a film contacting the heater and pressurizer contacting the heater through the film, wherein a recording material having an unfixed image formed thereon passes through between the film and pressurizer to effect fixing by the application of heat.

Figure 4:
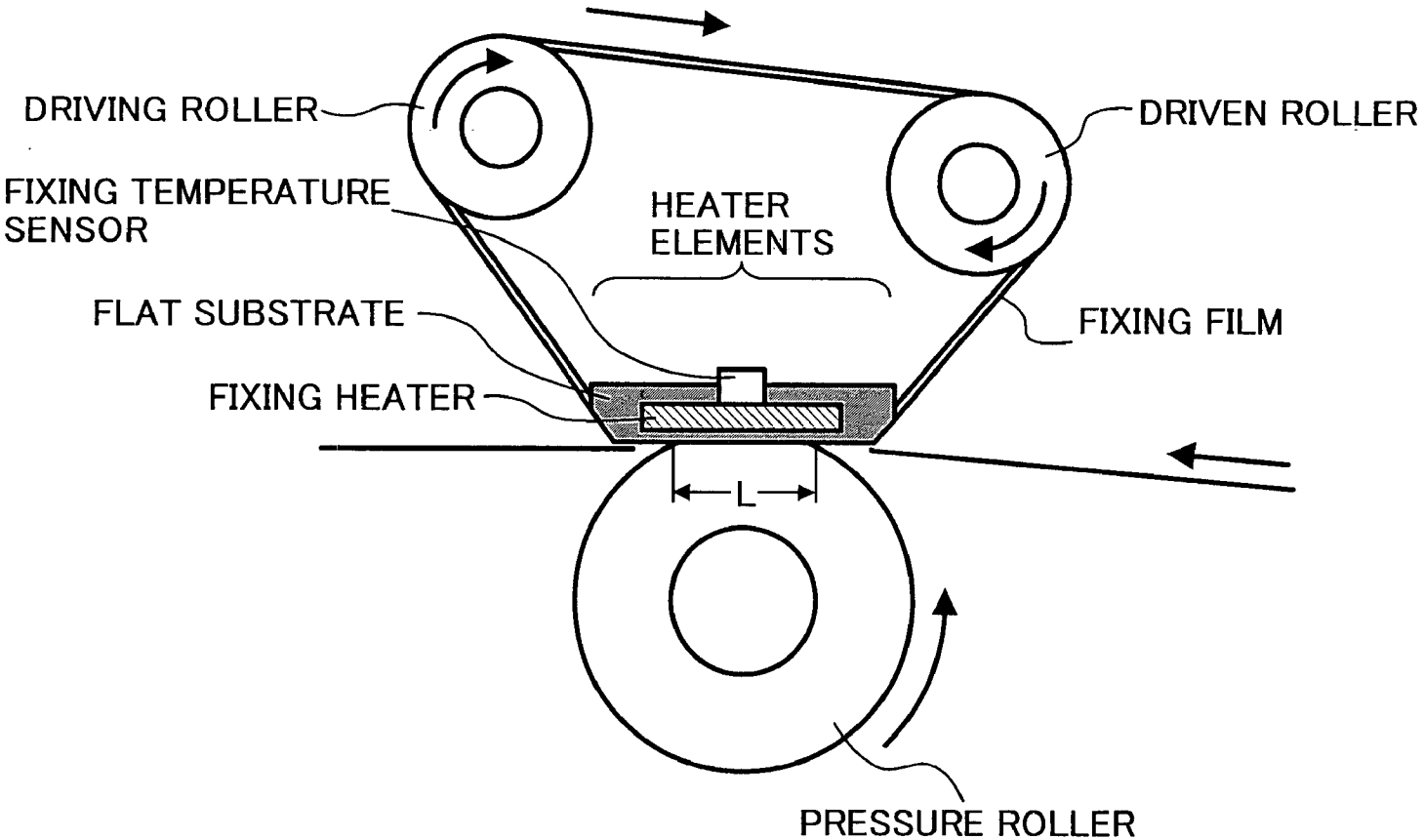
FIG. 4 is a schematic view illustrating a surf fixer rotating a fixing film to fix a toner image in the present invention.

The fixer is a surf fixer rotating a fixing film as shown in FIG. 4.

The fixing film is a heat resistant film having the shape of an endless belt, which is suspended and strained between a driving roller, a driven roller, and a heater located therebetween underneath.

The driven roller is also a tension roller, and the fixing film rotates clockwise as shown in FIG. 4. The rotational speed of the fixing film is equivalent to that of a transfer material at a fixing nip area L where a pressure roller and the fixing film contact each other.

The pressure roller has a rubber elastic layer having good releasability such as silicone rubbers, and rotates counterclockwise while contacting the fixing nip area L at a total pressure ranging from 4 to 10 $kg/ms^2$.

The fixing film preferably has a good heat resistance, releasability, and durability, and has a total thickness not greater than 100 μm, and preferably not greater than 40 μm. Specific examples include films formed of a single-layered or a multi-layered film of heat resistant resins, such as polyimide, polyetherimide, polyethersulfide (PES), and a tetrafluoroethyleneperfluoroalkylvinylethe copolymer resin, (PFA) having a thickness of 20 μm, on which, contacting an image, a release layer, including a fluorocarbon resin, such as a tetrafluoroethylene resin (PTFE) and a PFA and an electroconductive material, having a thickness of 10 μm, or an elastic layer formed of a rubber, such as a fluorocarbon rubber and a silicone rubber, is coated.

The image forming apparatus having such a fixer in the present invention can prevent carrier adhesion and effectively prolong the life of each contact member without damage.

As illustrated in FIG. 4, the heater is formed of a flat substrate and a fixing heater, the flat substrate being formed of a material having a high heat conductivity and a high resistivity such as alumina. The fixing heater comprises a resistance heater element located on a surface of the heater contacting the fixing film in the longitudinal direction. An electric resistant material such as Ag/Pd and $Ta_2N$ is linearly or zonally coated on the fixing heater by, for example, a screen printing method. Both ends of the fixing heater have electrodes (not shown) and heat is generated by the appreciation of electricity to the electrodes.

Further, a fixing temperature sensor formed of a thermistor is located on the other side of the substrate opposite to the side on which the fixing heater is located. Temperature information of the substrate detected by the fixing temperature sensor is transmitted to a controller controlling the supply of electric energy to the fixing heater in order to assure that the heater temperature will be maintained within a predetermined value.

Having generally described the invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Manganese oxide and iron oxide were mixed at a molar ratio (Mn/Fe) of 35/65. After the mixture was pulverized and dispersed by a ball mill in water using a wet pulverizing and dispersing method for 48 hrs, the mixture was dried and pre-fired at 900° C. for 1 hr in a weak reducing atmosphere.

The wet pulverization was performed by filling zirconia balls, having a diameter of 10 mm, in a ball mill pot at 30% by volume of the ball mill pot capacity and an oxide slurry having a solid content of 25% by 20% by volume of the slurry.

After crushed, the pre-fired mixture was pulverized and dispersed again by a ball mill in water by a wet pulverizing and dispersing method for 24 hrs to prepare a slurry of manganese and iron complex oxide.

Polyvinylalcohol and a dispersant were added to the slurry as a binder, and the slurry was granulated and dried by a spray drier, and then classified by a supersonic vibration sieve to prepare granulated particles.

The granulated particles were fired at 1,200° C. for 4 hrs in a normal atmosphere in an electric heating oven to prepare manganese ferrite particles.

Further, the manganese ferrite particles were classified by the supersonic vibration sieve to prepare a core material (1).

The following materials were dispersed by a homomixer for 30 min to prepare a coating liquid for forming a coated layer.

| | |
|---|---|
| Acrylic rein solution having a solid content of 50% by weight | 60 |
| Guanamine solution having a solid content of 70% by weight | 15 |
| Straight silicone resin having a solid content of 20 | 150 |
| Dibutyltin diacetate | 1.5 |
| Alumina particles having a number-averaged particle diameter of 0.3 μm | 100 |
| Carbon black | 6 |
| Toluene | 1,500 |

After this coating liquid was coated on the core material (1) by a fluidized-bed spray coater, the coated core material was heated in an atmosphere having a temperature of 150° C. for 1 hr to prepare a carrier (C1).

A particle diameter distribution of the carrier (C1) was measured by a particle diameter distribution measurer Model X100® from Microtrac Inc. to find that the carrier (C1) had a mass-averaged particle diameter (D4) of 37.5 μm, a number-averaged particle diameter (D1) of 34.3 μm and that a content of the carrier particles having a particle diameter not greater than 12 μm was 0.14% by weight.

A surface of the carrier (C1) was observed by a scanning electron microscope to find that concavities and convexities of alumina were formed, and an average vertical interval of the concavities and convexities on the surface thereof measured by a laser microscope without contacting the surface was 0.3 μm.

A magnetization (σb) of the carrier (C1) at 1,000 Oe measured by a multi-sample rotational magnetization device REM-1-10® from TOEI INDUSTRY CO., LTD. was 66.0 emu/g.

A desorption test of the carrier (C1) was performed as follows.

First, as a test sample, a developing sleeve of a color printer IPSio color 8000® from Ricoh Company, Ltd. was modified such that the developing pole had a peak magnetic flux density of 100 mT.

Next, the sample developing sleeve was installed in a developing unit and its rotational speed was controlled such that the applied centrifugal force (desorption force) was 3 times as much as the gravitational force (the developing sleeve diameter was 18 mm and its rotational speed was 546 rpm {i.e., $3\times9.8\ (m/s^2)\times0.009\ (m)\}^{1/2}\times1{,}000\ (mm)/\{18\ (mm)\times\pi\}\times60\ (sec)=546$ rpm).

250 g of the carrier (C1) were put in the developing unit and the developing sleeve was continuously rotated for 30 min to collect the desorbed carrier from an opening of a developing area of the developing unit to evaluate its compositional uniformity.

The desorbed carrier was elementally analyzed by an EPMA to find its manganese and iron element distributions. Images of 100 carrier particles were analyzed to find number standard content rate of the manganese and iron atoms of the individual carrier particles, and an average and a standard deviation of the ratio of the amount of manganese to the combined amount of iron and manganese were determined to obtain a variation coefficient.

The average M of the manganese element and variation coefficient K are shown in Table 1-1.

The following materials were kneaded by a two-roll kneader for 30 min, and the kneaded mixture was pulverized and classified by a mechanical pulverizer and a n airstream classifier to prepare a mother toner.

| | |
|---|---|
| Partially cross-linked polyester resin (A condensation polymer of an adduct alcohol of bisphenol A with ethylene oxide, an adduct alcohol of bisphenol A with propylene oxide, a terephthalic acid and trimellitic acid, having a weight-averaged molecular weight of 15,000 and a glass transition temperature of 61° C.) | 79.5 |
| Carbon black | 15 |
| Zirconium salt of Di-tert-butyl salicylate | 1 |
| Carnauba wax from CERARICA NODA Co., Ltd. | 5 |

Further, each one part of hydrophobic silica fine particles and hydrophobic titanium oxide fine particles were added to 100 parts of the mother toner, and the mixture was mixed by a Henschel mixer for 2 min to prepare a toner (T1).

The particle diameter distribution of the toner (T1) was measured by a Coulter counter TA2® to find that the toner (T1) had a mass-averaged particle diameter D4 of 6.2 μm and, on a cumulative number basis, 10% of the particles were larger than 2.5 μm.

Next, 920 parts of the carrier (C1) and 80 parts of the toner (T1) were mixed by a tubular mixer for 1 min to prepare a two-component developer.

300,000 copies of an A4 original having an image area ratio of 6% were continuously produced by a color printer IPSio color 8000® from Ricoh Company, Ltd. with the two-component developer. Image qualities of the initial image and the image after 300,000 copies were produced of a letter image, a halftone image, and a solid image were evaluated.

The developing pole had a magnetic flux density of 110 mT and a minimum distance between the developing sleeve and the photoreceptor in the developing section was 0.6 mm.

An electrostatic latent image on the image bearer had a potential of −700 V at the background and −200 V at the image area when the image was produced. A developing bias in which a DC voltage of −500 V was overlapped with an AC voltage having a peak-to-peak voltage of 1,500 V and a frequency of 2,000 Hz was applied to the developing sleeve.

Whether the blank image and solid image had carrier adhesion, the letter was fattened, the half tone image had a surface roughness and each image had other defects, and a gradient of the halftone image and stability of the image density of the solid image were evaluated.

Both the initial images and images after 300,000 copies had good image qualities, and therefore the carrier of the present invention can effectively be used for good image quality and extended developer life.

The image density was measured by Macbeth densitometer RD-914 ® and the other items were visually evaluated.

The evaluation results of each initial image and image after 300,000 copies were produced are shown in Tables 1-1, 1-2 and 1-3.

Example 2

The procedures for preparation and evaluation of the two-component developer in Example 1 were repeated except for pulverizing and dispersing the manganese oxide and iron oxide by a ball mill for 24 hrs instead of 48 hrs before pre-firing to prepare a core material (2) and a carrier (C2).

The evaluation results are shown in Tables 1-1, 1-2 and 1-3.

Example 3

The procedures for preparation and evaluation of the two-component developer in Example 1 were repeated except for pulverizing and dispersing the manganese oxide and iron oxide by a ball mill for 120 hrs instead of 48 hrs before pre-firing and pulverizing and dispersing the mixture thereof by a ball mill for 48 hrs instead of 24 hrs after pre-firing to prepare a core material (3) and a carrier (C3).

The evaluation results are shown in Tables 1-1, 1-2 and 1-3.

Example 4

The procedures for preparation and evaluation of the two-component developer in Example 1 were repeated except for changing the molar ratio (Mn/Fe) from 35/65 to 10/90 and firing the granulated particles at 1,250° C. in a weak reducing atmosphere instead of 1,200° C. in a normal atmosphere to prepare a core material (4) and a carrier (C4).

The evaluation results are shown in Tables 1-1, 1-2 and 1-3.

Example 5

The procedures for preparation and evaluation of the two-component developer in Example 1 were repeated except for changing the molar ratio (Mn/Fe) from 35/65 to 40/60 to prepare a core material (5) and a carrier (C5).

The evaluation results are shown in Tables 1-1, 1-2 and 1-3.

Example 6

The procedures for preparation and evaluation of the two-component developer in Example 4 were repeated except for firing the granulated particles at 1,250° C. in a strong reducing atmosphere instead of the weak reducing atmosphere to prepare a core material (6) and a carrier (C6).

The evaluation results are shown in Tables 1-1, 1-2 and 1-3.

Example 7

The procedures for preparation and evaluation of the two-component developer in Example 1 were repeated except for changing the molar ratio (Mn/Fe) from 35/65 to 45/55 to prepare a core material (7) and a carrier (C7).

The evaluation results are shown in Tables 1-1, 1-2 and 1-3.

Example 8

The procedures for preparation and evaluation of the two-component developer in Example 1 were repeated except for controlling the granulation conditions and the classifying conditions of the manganese ferrite particles with the supersonic vibration sieve after fired to prepare a core material (8) having a slightly larger average particle diameter and a carrier (C8).

The evaluation results are shown in Tables 1-1, 1-2 and 1-3.

Example 9

The procedures for preparation and evaluation of the two-component developer in Example 1 were repeated except for controlling the granulation conditions and the classifying conditions of the manganese ferrite particles with the supersonic vibration sieve after fired to prepare a core material (9) having a slightly smaller average particle diameter and a carrier (C9). The evaluation results are shown in Tables 1-1, 1-2 and 1-3.

Example 10

The procedures for preparation and evaluation of the two-component developer in Example 1 were repeated except for controlling the granulation conditions and the classifying conditions of the manganese ferrite particles with the supersonic vibration sieve after fired to prepare a core material (10) having a slightly larger amount of a fine powder and a carrier (C10). The evaluation results are shown in Tables 1-1, 1-2 and 1-3.

Example 11

The procedures for preparation and evaluation of the two-component developer in Example 1 were repeated except for controlling the granulation conditions and the classifying conditions of the manganese ferrite particles with the supersonic vibration sieve after fired to prepare a core material (11) having a slightly broader particle diameter distribution and a carrier (C11).

The evaluation results are shown in Tables 1-1, 1-2 and 1-3.

Example 12

The procedures for preparation and evaluation of the two-component developer in Example 1 were repeated except for changing the parts of the alumina particles and carbon black from 100 to 50 and 6 to 4, respectively, for use in the coating liquid for the core material of the carrier to prepare a carrier (C12).

The evaluation results are shown in Tables 1-1, 1-2 and 1-3.

Example 13

The procedures for preparation and evaluation of the two-component developer in Example 1 were repeated except for excluding the alumina particles and changing the parts of the carbon black from 6 to 1 for use in the coating liquid for the core material of the carrier (C13).

The evaluation results are shown in Tables 1-1, 1-2 and 1-3.

Example 14

The procedures for preparation and evaluation of the two-component developer in Example 1 were repeated except for excluding the alumina particles and changing the parts of the carbon black from 6 to 8 for use in the coating liquid for the core material of the carrier (C14).

The evaluation results are shown in Tables 1-1, 1-2 and 1-3.

Example 15

The procedures for preparation and evaluation of the two-component developer in Example 1 were repeated except for excluding the alumina particles and changing the parts of the carbon black from 6 to 3 for use in the coating liquid for the core material of the carrier (C15).

The evaluation results are shown in Tables 1-1 1, 1-2 and 1-3.

Examples 16 and 17

The procedures for preparation and evaluation of the two-component developer in Example 1 were repeated except for controlling the pulverizing and classifying conditions of the kneaded mixture to prepare a mother toner having a mass-averaged particle diameter of 11 μm (T2) and a mother toner having a mass-averaged particle diameter of 3.8 μm (T3).

The evaluation results are shown in Tables 1-1, 1-2 and 1-3.

Comparative Example 1

Manganese oxide and iron oxide were mixed at a molar ratio (Mn/Fe) of 35/65. After the mixture was pulverized and dispersed by a ball mill in water in a wet pulverizing and dispersing method for 18 hrs, the mixture was dried and pre-fired at 850° C. for 1 hr in a weak reducing atmosphere.

The wet pulverization was performed by filling zirconia balls having a diameter of 10 mm in a ball mill pot by 25% by volume of the ball mill pot capacity and an oxide slurry including a solid content of 25% by 20% by volume thereof.

After crushed, the pre-fired mixture was pulverized and dispersed again by a ball mill in water by a wet pulverizing and dispersing method for 24 hrs to prepare a slurry of manganese and iron complex oxide.

Polyvinylalcohol and a dispersant were added to the slurry as a binder, and the slurry was granulated and dried by a spray drier, and then classified by a supersonic vibration sieve to prepare granulated particles.

The granulated particles were fired at 1,200° C. for 4 hrs in a weak reducing atmosphere to prepare manganese ferrite particles.

Further, the manganese ferrite particles were classified by the supersonic vibration sieve to prepare a core material (12).

The other procedures for preparation and evaluation of the two-component developer in Example 1 were repeated except for using a carrier (C16) including the core material (12).

The evaluation results are shown in Tables 1-1, 1-2 and 1-3.

Comparative Example 2

The procedures for preparation and evaluation of the two-component developer in Example 1 were repeated except for changing the molar ratio (Mn/Fe) from 35/65 to 3/97 and firing the granulated particles at 1,250° C. in a reducing atmosphere for 5 hrs instead of 1,200° C. in a normal atmosphere for 4 hrs to prepare a core material (13) and a carrier (C17).

The evaluation results are shown in Tables 1-1, 1-2 and 1-3.

Comparative Example 3

The procedures for preparation and evaluation of the two-component developer in Example 1 were repeated except for changing the molar ratio (Mn/Fe) from 35/65 to 50/50 to prepare a core material (14) and a carrier (C18).

The evaluation results are shown in Tables 1-1, 1-2 and 1-3.

Comparative Example 4

The procedures for preparation and evaluation of the two-component developer in Example 1 were repeated except for changing the molar ratio (Mn/Fe) from 35/65 to 7/93 and firing the granulated particles at 1,250° C. in a strong reducing atmosphere for 5 hrs instead of 1,200° C. in a normal atmosphere for 4 hrs to prepare a core material (15) and a carrier (C19).

The evaluation results are shown in Tables 1-1, 1-2 and 1-3.

Comparative Example 5

The procedures for preparation and evaluation of the two-component developer in Example 1 were repeated except for changing the molar ratio (Mn/Fe) from 35/65 to 40/60 and firing the granulated particles at 1,200° C. in a normal atmosphere for 8 hrs to prepare a core material (16) and a carrier (C20).

The evaluation results are shown in Tables 1-1, 1-2 and 1-3.

Comparative Example 6

The procedures for preparation and evaluation of the two-component developer in Example 1 were repeated except for controlling the granulation conditions and the classifying conditions of the manganese ferrite particles with the supersonic vibration sieve after fired to prepare a core material (17) having a smaller average particle diameter and a carrier (C21).

The evaluation results are shown in Tables 1-1, 1-2 and 1-3.

Comparative Example 7

The procedures for preparation and evaluation of the two-component developer in Example 1 were repeated except for controlling the granulation conditions and the classifying conditions of the manganese ferrite particles with the supersonic vibration sieve after fired to prepare a core material (18) having a larger average particle diameter and a carrier (C22).

The evaluation results are shown in Tables 1-1, 1-2 and 1-3.

Comparative Example 8

The procedures for preparation and evaluation of the two-component developer in Example 1 were repeated except for controlling the granulation conditions and the classifying conditions of the manganese ferrite particles with the supersonic vibration sieve after fired to prepare a core material (19) having a large amount of a fine powder and a carrier (C23).

The evaluation results are shown in Tables 1-1, 1-2 and 1-3.

Comparative Example 9

The procedures for preparation and evaluation of the two-component developer in Example 1 were repeated except for controlling the granulation conditions and the classifying conditions of the manganese ferrite particles with the supersonic vibration sieve after fired to prepare a core material (20) having a broad particle diameter distribution and a carrier (C24).

The evaluation results are shown in Tables 1-1, 1-2 and 1-3.

Example 18

The procedures for preparation and evaluation of the two-component developer in Example 1 were repeated except for mixing 850 parts of the carrier (C1) and 150 parts of the toner (T1) by a tubular mixer for 3 min instead of mixing 920 parts of the carrier (C1) and 80 parts of the toner (T1) by the tubular mixer for 1 min.

The evaluation results are shown in Tables 1-1, 1-2 and 1-3.

Examples 19 and 20

The procedures for preparation and evaluation of the two-component developers in Examples 1 and 6 were repeated except for changing a magnet in the developing sleeve so as to have a developing pole having a peak magnetic flux density of 140 mT.

The evaluation results are shown in Tables 1-1, 1-2 and 1-3.

Examples 21 and 22

The procedures for preparation and evaluation of the two-component developers in Examples 1 and 7 were repeated except for changing a magnet in the developing sleeve so as to have a developing pole having a peak magnetic flux density of 70 mT.

The evaluation results are shown in Tables 1-1, 1-2 and 1-3.

Examples 23 and 24

The procedures for preparation and evaluation of the two-component developer in Examples 1 were repeated except for changing the minimum distance between the developing sleeve and the photoreceptor in the developing section from 0.6 to 0.25 and 0.9 mm.

The evaluation results are shown in Tables 1-1, 1-2 and 1-3.

Example 25

The procedures for preparation and evaluation of the two-component developer in Examples 1 were repeated except for applying only the DC voltage of −500 V as the developing bias instead of the DC voltage of −500 V overlapped with an AC voltage having a peak-to-peak voltage of 1,500 V and a frequency of 2,000 Hz.

The evaluation results are shown in Tables 1-1, 1-2 and 1-3.

TABLE 1-1

| | | | Carrier | | | | | | | | |
|---|---|---|---|---|---|---|---|---|---|---|---|
| | | | M | K | σb (emu/g) | D4 (μm) | D1 (μm) | 12 μm or less (wt. %) | D4/D1 | Ω · cm | *(μm) |
| Ex. 1 | C1 | T1 | 0.35 | 23 | 65 | 36.2 | 34.3 | 0.09 | 1.06 | $1.4 \times 10^{10}$ | 0.3 |
| Ex. 2 | C2 | T1 | 0.36 | 30 | 64 | 35.8 | 34.8 | 0.12 | 1.03 | $1.3 \times 10^{10}$ | 0.3 |
| Ex. 3 | C3 | T1 | 0.35 | 4 | 65 | 35.4 | 32.5 | 0.11 | 1.09 | $1.5 \times 10^{10}$ | 0.3 |
| Ex. 4 | C4 | T1 | 0.10 | 28 | 70 | 36.0 | 33.1 | 0.06 | 1.09 | $9.6 \times 10^{9}$ | 0.3 |
| Ex. 5 | C5 | T1 | 0.40 | 18 | 54 | 35.9 | 34.0 | 0.09 | 1.06 | $5.2 \times 10^{10}$ | 0.3 |
| Ex. 6 | C6 | T1 | 0.10 | 28 | 74 | 39.2 | 33.8 | 0.18 | 1.16 | $8.3 \times 10^{9}$ | 0.3 |
| Ex. 7 | C7 | T1 | 0.40 | 20 | 47 | 36.7 | 34.5 | 0.09 | 1.06 | $4.3 \times 10^{10}$ | 0.3 |
| Ex. 8 | C8 | T1 | 0.35 | 26 | 65 | 27.8 | 27.4 | 0.20 | 1.01 | $9.2 \times 10^{9}$ | 0.3 |
| Ex. 9 | C9 | T1 | 0.35 | 21 | 65 | 60.0 | 56.8 | 0.01 | 1.06 | $2.1 \times 10^{10}$ | 0.3 |
| Ex. 10 | C10 | T1 | 0.36 | 27 | 64 | 35.9 | 32.4 | 0.27 | 1.11 | $1.3 \times 10^{10}$ | 0.3 |
| Ex. 11 | C11 | T1 | 0.35 | 25 | 65 | 39.2 | 30.7 | 0.24 | 1.28 | $1.2 \times 10^{10}$ | 0.3 |
| Ex. 12 | C12 | T1 | 0.35 | 23 | 65 | 35.6 | 34.6 | 0.07 | 1.03 | $9.7 \times 10^{9}$ | 0.05 |
| Ex. 13 | C13 | T1 | 0.35 | 22 | 65 | 36.3 | 34.9 | 0.06 | 1.04 | $9.0 \times 10^{9}$ | — |
| Ex. 14 | C14 | T1 | 0.35 | 21 | 65 | 35.7 | 33.5 | 0.13 | 1.07 | $9.8 \times 10^{8}$ | 0.3 |
| Ex. 15 | C15 | T1 | 0.35 | 24 | 65 | 36.1 | 35.4 | 0.10 | 1.02 | $1.1 \times 10^{11}$ | 0.3 |
| Ex. 16 | C1 | T2 | 0.35 | 23 | 65 | 36.2 | 34.3 | 0.09 | 1.06 | $1.4 \times 10^{10}$ | 0.3 |
| Ex. 17 | C1 | T3 | 0.35 | 23 | 65 | 36.2 | 34.3 | 0.09 | 1.06 | $1.4 \times 10^{10}$ | 0.3 |
| Ex. 18 | C1 | T1 | 0.35 | 23 | 65 | 36.2 | 34.3 | 0.09 | 1.06 | $1.4 \times 10^{10}$ | 0.3 |
| Ex. 19 | C1 | T1 | 0.35 | 23 | 65 | 36.2 | 34.3 | 0.09 | 1.06 | $1.4 \times 10^{10}$ | 0.3 |
| Ex. 20 | C6 | T1 | 0.10 | 28 | 74 | 39.2 | 33.8 | 0.18 | 1.06 | $8.3 \times 10^{9}$ | 0.3 |
| Ex. 21 | C1 | T1 | 0.35 | 23 | 65 | 36.2 | 34.3 | 0.09 | 1.06 | $1.4 \times 10^{10}$ | 0.3 |
| Ex. 22 | C7 | T1 | 0.40 | 20 | 47 | 36.7 | 34.5 | 0.09 | 1.06 | $4.3 \times 10^{10}$ | 0.3 |
| Ex. 23 | C1 | T1 | 0.35 | 23 | 65 | 36.2 | 34.3 | 0.09 | 1.06 | $1.4 \times 10^{10}$ | 0.3 |
| Ex. 24 | C1 | T1 | 0.35 | 23 | 65 | 36.2 | 34.3 | 0.09 | 1.06 | $1.4 \times 10^{10}$ | 0.3 |
| Ex. 25 | C1 | T1 | 0.35 | 23 | 65 | 36.2 | 34.3 | 0.09 | 1.06 | $1.4 \times 10^{10}$ | 0.3 |
| Com. Ex. 1 | C16 | T1 | 0.34 | 35 | 66 | 36.5 | 34.9 | 0.09 | 1.05 | $1.5 \times 10^{10}$ | 0.3 |
| Com. Ex. 2 | C17 | T1 | 0.03 | 16 | 72 | 35.1 | 34.6 | 0.06 | 1.01 | $7.1 \times 10^{9}$ | 0.3 |
| Com. Ex. 3 | C18 | T1 | 0.50 | 21 | 44 | 34.7 | 33.2 | 0.11 | 1.05 | $5.2 \times 10^{10}$ | 0.3 |
| Com. Ex. 4 | C19 | T1 | 0.07 | 29 | 76 | 36.1 | 35.6 | 0.10 | 1.01 | $7.9 \times 10^{9}$ | 0.3 |
| Com. Ex. 5 | C20 | T1 | 0.40 | 22 | 42 | 34.9 | 33.7 | 0.14 | 1.04 | $5.5 \times 10^{10}$ | 0.3 |
| Com. Ex. 6 | C21 | T1 | 0.35 | 27 | 65 | 23.7 | 23.6 | 1.21 | 1.00 | $7.9 \times 10^{9}$ | 0.3 |
| Com. Ex. 7 | C22 | T1 | 0.35 | 17 | 65 | 73.9 | 71.4 | 0.00 | 1.04 | $3.0 \times 10^{10}$ | 0.3 |
| Com. Ex. 8 | C23 | T1 | 0.36 | 28 | 65 | 34.1 | 31.9 | 0.35 | 1.074 | $1.0 \times 10^{10}$ | 0.3 |
| Com. Ex. 9 | C24 | T1 | 0.35 | 26 | 65 | 39.1 | 28.7 | 0.26 | 1.36 | $9.7 \times 10^{9}$ | 0.3 |

*Vertical interval between concavity and convexity

TABLE 1-2

| | Initial Image Quality | | | | | |
|---|---|---|---|---|---|---|
| | Carrier adhesion | Letter fattening | Halftone image surface roughness | Gradient | Image density | Other defects |
| Ex. 1 | ◎ | ◎ | ◎ | ◎ | 1.42 | |
| Ex. 2 | ○ | ◎ | ◎ | ◎ | 1.43 | |
| Ex. 3 | ◎ | ◎ | ◎ | ◎ | 1.42 | |
| Ex. 4 | ○ | ◎ | ○ | ◎ | 1.40 | |
| Ex. 5 | ○ | ○ | ◎ | ◎ | 1.43 | |
| Ex. 6 | ○ | ◎ | ○ | ○ | 1.38 | |
| Ex. 7 | ○ | ○ | ◎ | ◎ | 1.44 | |
| Ex. 8 | ○ | ◎ | ◎ | ◎ | 1.39 | |
| Ex. 9 | ◎ | ○ | ○ | ○ | 1.37 | |
| Ex. 10 | ○ | ◎ | ◎ | ◎ | 1.42 | |
| Ex. 11 | ○ | ◎ | ◎ | ◎ | 1.42 | |
| Ex. 12 | ◎ | ○ | ◎ | ◎ | 1.40 | |
| Ex. 13 | ◎ | ○ | ○ | ○ | 1.38 | |
| Ex. 14 | ◎ | ○ | ◎ | ◎ | 1.44 | |
| Ex. 15 | ○ | ◎ | ◎ | ○ | 1.37 | |
| Ex. 16 | ◎ | ◎ | ◎ | ○ | 1.44 | |

TABLE 1-2-continued

| | Initial Image Quality | | | | | |
|---|---|---|---|---|---|---|
| | Carrier adhesion | Letter fattening | Halftone image surface roughness | Gradient | Image density | Other defects |
| Ex. 17 | ◎ | ○ | ◎ | ◎ | 1.36 | Slightly foggy background |
| Ex. 18 | ◎ | Δ | ◎ | ○ | 1.44 | Slight contamination in the apparatus |
| Ex. 19 | ◎ | ◎ | ◎ | ○ | 1.42 | |
| Ex. 20 | ◎ | ◎ | ◎ | Δ | 1.34 | |
| Ex. 21 | ○ | ◎ | ◎ | ◎ | 1.41 | |
| Ex. 22 | Δ | ○ | ◎ | ○ | 1.45 | |
| Ex. 23 | ○ | ◎ | ○ | ○ | 1.36 | |
| Ex. 24 | ○ | ◎ | ◎ | Δ | 1.37 | |
| Ex. 25 | ◎ | ○ | ◎ | ○ | 1.41 | |
| Com. Ex. 1 | X | ◎ | ◎ | ◎ | 1.43 | |
| Com. Ex. 2 | ◎ | ○ | Δ | Δ | 1.42 | |
| Com. Ex. 3 | X | Δ | ○ | ○ | 1.44 | |
| Com. Ex. 4 | X | ○ | X | ○ | 1.37 | |
| Com. Ex. 5 | X | Δ | ○ | ○ | 1.48 | |
| Com. Ex. 6 | X | ○ | Δ | ○ | 1.36 | |
| Com. Ex. 7 | ◎ | Δ | Δ | X | 1.37 | Much foggy background |
| Com. Ex. 8 | X | ○ | ○ | ○ | 1.41 | |
| Com. Ex. 9 | X | ○ | ○ | ◎ | 1.39 | |

◎: Very good
○: Practically usable
Δ: Acceptable
X: Unusable

TABLE 1-3

| | Image Quality after 300,000 images were produced | | | | | |
|---|---|---|---|---|---|---|
| | Carrier adhesion | Letter fattening | Halftone image surface roughness | Gradient | Image density | Other defects |
| Ex. 1 | ◎ | ◎ | ◎ | ◎ | 1.43 | |
| Ex. 2 | ◎ | ◎ | ◎ | ◎ | 1.42 | |
| Ex. 3 | ◎ | ◎ | ◎ | ◎ | 1.42 | |
| Ex. 4 | ◎ | ◎ | ○ | ◎ | 1.41 | |
| Ex. 5 | ○ | ○ | ◎ | ◎ | 1.42 | |
| Ex. 6 | ○ | ◎ | ◎ | ○ | 1.39 | |
| Ex. 7 | ○ | ○ | ◎ | ◎ | 1.41 | |
| Ex. 8 | ◎ | ◎ | ◎ | ○ | 1.40 | |
| Ex. 9 | ◎ | ○ | ○ | ○ | 1.35 | |
| Ex. 10 | ◎ | ◎ | ◎ | ◎ | 1.44 | |
| Ex. 11 | ◎ | ○ | ◎ | ◎ | 1.39 | |
| Ex. 12 | ◎ | Δ | ◎ | ○ | 1.41 | |
| Ex. 13 | ◎ | Δ | ○ | Δ | 1.41 | |
| Ex. 14 | ◎ | ○ | Δ | ○ | 1.42 | |
| Ex. 15 | ◎ | ○ | ◎ | Δ | 1.40 | |
| Ex. 16 | ◎ | ○ | ◎ | ○ | 1.43 | |
| Ex. 17 | ◎ | Δ | ◎ | ○ | 1.35 | Slightly foggy background |
| Ex. 18 | ◎ | ○ | ◎ | ◎ | 1.42 | |
| Ex. 19 | ◎ | ○ | ◎ | Δ | 1.41 | |
| Ex. 20 | ○ | Δ | ○ | Δ | 1.37 | Photoreceptor slightly damaged |
| Ex. 21 | ◎ | ◎ | ◎ | ◎ | 1.40 | |
| Ex. 22 | ○ | ○ | ◎ | Δ | 1.46 | |
| Ex. 23 | ○ | ◎ | Δ | ○ | 1.37 | Photoreceptor slightly damaged |
| Ex. 24 | ◎ | ○ | ◎ | Δ | 1.39 | |
| Ex. 25 | ◎ | ○ | ◎ | Δ | 1.42 | |
| Com. Ex. 1 | Δ | ◎ | ◎ | ◎ | 1.37 | |
| Com. Ex. 2 | ◎ | ○ | X | X | 1.45 | |
| Com. Ex. 3 | X | Δ | ◎ | Δ | 1.40 | |

TABLE 1-3-continued

| | Image Quality after 300,000 images were produced | | | | | |
|---|---|---|---|---|---|---|
| | Carrier adhesion | Letter fattening | Halftone image surface roughness | Gradient | Image density | Other defects |
| Com. Ex. 4 | Δ | ○ | Δ | ○ | 1.35 | Photoreceptor and fixing members largely damaged |
| Com. Ex. 5 | X | Δ | ○ | Δ | 1.41 | |
| Com. Ex. 6 | X | Δ | Δ | ○ | 1.38 | |
| Com. Ex. 7 | ◎ | Δ | ○ | X | 1.36 | Much foggy background |
| Com. Ex. 8 | X | ○ | Δ | ○ | 1.41 | |
| Com. Ex. 9 | Δ | ○ | ○ | Δ | 1.42 | |

◎: Very good
○: Practically usable
Δ: Acceptable
X: Unusable

Finally, in Examples 1, 3 and 21, 1,000,000 images were successively produced to find that the final image of each example had high resolution and definition utterly equivalent to those of the initial image.

Having now fully described the invention, it will be apparent to one of ordinary skill in the art that many changes and modifications can be made thereto without departing from the spirit and scope of the invention as set forth herein in the claims.

What is claimed as new and desired to be secured by Letters Patent of the United States is:

1. A carrier, comprising:

a manganese ferrite core material; and a layer located on a surface of the manganese ferrite core material, wherein the carrier satisfies the following conditions:

$$0.1 \leqq K \leqq 30,$$

where K=(S/M)×100, S and M represent, respectively, a standard deviation and an average of the expression M2/(M1+M2), wherein said average ranges from 0.05 to 0.45, and where M1 and M2 represent, respectively, a content of iron and a content of manganese in a carrier particle determined by a method comprising:

magnetically holding the carrier on a cylindrical sleeve having a magnetic pole area located over a magnetic pole having a peak magnetic flux density of about 100 mT in a direction perpendicular to a rotational axis of the cylindrical sleeve;

rotating the cylindrical sleeve around the rotational axis for 30 min; and removing the carrier from the magnetic pole area by applying a force in said direction, said force being approximately equal to three times as much as a gravitational weight of the carrier;

a magnetization ranging from approximately 45 to 75 emu/g at 1,000 Oe;

a mass-averaged particle diameter, D4, between 25 and 65 μm, wherein carrier particles having a particle diameter not greater than 12 μm are included in an amount not greater than 0.3% by weight; and a ratio D4/D1 is between 1 and 1.3, where D1 is a number-averaged particle diameter of the carrier.

2. The carrier of claim 1, wherein a resistivity R of the carrier is from $1.0\times10^{9}$ to $1.0\times10^{11}$ Ω·cm when an AC voltage having a peak voltage, E, is applied at a frequency of 1,000 Hz to a magnetic brush of the carrier formed between parallel plate electrodes having a gap, d, such that the magnetic brush has a space occupancy of 40%, wherein $$E=250\times d \text{ and } d \text{ is } 0.40\pm0.05 \text{ mm}.$$

3. The carrier of claim 1, wherein the layer comprises a resin and an insulative inorganic particulate material.

4. The carrier of claim 1, wherein a surface of the carrier has an average vertical interval between 0.1 and 2.0 μm.

5. A developer comprising:

the carrier according to claim 1; and a toner comprising a binder resin and a colorant.

6. The developer of claim 5, wherein a resistivity R of the developer is from $1.0\times10^{9}$ to $1.0\times10^{11}$ Ω·cm when an AC voltage having a peak voltage, E, is applied at a frequency of 1,000 Hz to a magnetic brush of the carrier formed between parallel plate electrodes having a gap, d, such that the magnetic brush has a space occupancy of 40%, wherein $$E=250\times d \text{ and } d \text{ is } 0.40\pm0.05 \text{ mm}.$$

7. The developer of claim 5, wherein the toner is included in the developer in an amount ranging from 2 to 12% by weight.

8. The developer of claim 5, wherein the toner further comprises a release agent.

9. The developer of claim 5, wherein the toner has a mass-averaged particle diameter between 4 and 10 μm.

10. An electrophotographic image forming apparatus comprising:

a friction charger configured to frictionize the developer according to claim 5 to charge the toner;

at least one image developer comprising a rotatable holder including a magnetic field generator therein, said rotatable holder being configured to hold the developer; and an image bearer configured to bear an electrostatic latent image thereon, wherein the electrostatic latent image is developed with the developer at a developing area located between the image bearer and the rotatable holder, wherein a maximum magnetic flux density, B (mT), at the developing area in a direction normal to a surface of the rotatable holder is such that $$3{,}500/\sigma b \leqq B \leqq 10{,}000/\sigma b.$$

11. The electrophotographic image forming apparatus of claim 10, wherein a minimum distance between the rotatable holder and the image bearer varies from 0.30 to 0.80 mm.

12. The electrophotographic image forming apparatus of claim 10, further comprising a voltage applicator configured to apply a DC bias voltage to the rotatable holder.

13. The electrophotographic image forming apparatus of claim 12, wherein the voltage applicator applies a DC bias voltage overlapped with an AC voltage to the rotatable holder.

14. The electrophotographic image forming apparatus of claim 10, further comprising a recycler comprising:

a cleaner configured to clean the image bearer by collecting the toner remaining on a surface of the image bearer;

and a returner configured to return the collected toner to the rotatable holder.

15. The electrophotographic image forming apparatus of claim 10, wherein said at least one image developer is a plurality of image developers, said apparatus further comprising:

a transferer configured to transfer toner images formed one by one on the image bearer by the plurality of image developers onto a transfer medium; and a fixer configured to fix each of said toner images on the transfer medium.

16. The electrophotographic image forming apparatus of claim 15, wherein the fixer comprises:

a heater;

a film contacting the heater; and a pressurizer;

wherein the toner image is fixed on the transfer medium by being fed through a nip between the film and the pressurizer.

17. The electrophotographic image forming apparatus of claim 10, wherein the image bearer is an amorphous silicon photoreceptor.

18. A process cartridge comprising:

a friction charger configured to frictionize the developer according to claim 5 to charge the toner;

an image developer comprising a rotatable holder having a magnetic field generator therein, said rotatable holder being configured to hold the developer; and an image bearer configured to bear an electrostatic latent image thereon, wherein the electrostatic latent image is developed with the developer at a developing area located between the image bearer and the rotatable holder, wherein a maximum magnetic flux density, B (mT), at the developing area in a direction normal to a surface of the rotatable holder is such that $$3{,}500/\sigma b \leqq B \leqq 10{,}000/\sigma b.$$

19. A carrier, comprising:

a manganese ferrite core material; and a layer located on a surface of the manganese ferrite core material, wherein $0.1 \leqq K \leqq 30$, where $K=(S/M)\times 100$, S and M represent, respectively, a standard deviation and an average of the expression M2/(M1+M2), wherein said average ranges from 0.05 to 0.45, and where M1 and M2 represent, respectively, a content of iron and a content of manganese in a carrier particle.

20. The carrier according to claim 19, made by a method comprising:

magnetically holding the carrier on a cylindrical sleeve having a magnetic pole area located over a magnetic pole having a peak magnetic flux density of about 100 mT in a direction perpendicular to a rotational axis of the cylindrical sleeve;

rotating the cylindrical sleeve around the rotational axis for 30 min; and removing the carrier from the magnetic pole area by applying a force in said direction, said force being approximately equal to three times as much as a gravitational weight of the carrier.

21. The carrier according to claim 19, further comprising:

a magnetization ranging from approximately 45 to 75 emu/g at 1,000 Oe.

22. The carrier according to claim 21, wherein, a mass-averaged particle diameter, D4, is between 25 and 65 μm, and carrier particles having a particle diameter not greater than 12 μm are included in an amount not greater than 0.3% by weight.

23. The carrier according to claim 22, wherein, a ratio D4/D1 is between 1 and 1.3, where D1 is a number-averaged particle diameter of the carrier.

24. The carrier according to claim 23, wherein a resistivity R of the carrier is from $1.0\times 10^{9}$ to $1.0\times 10^{11}$ Ω·cm when an AC voltage having a peak voltage, E, is applied at a frequency of 1,000 Hz to a magnetic brush of the carrier formed between parallel plate electrodes having a gap, d, such that the magnetic brush has a space occupancy of 40%, $E=250\times d$, and d is 0.40±0.05 mm.

* * * * *